US011691832B2

(12) United States Patent
Migita et al.

(10) Patent No.: US 11,691,832 B2
(45) Date of Patent: Jul. 4, 2023

(54) MEDIUM TRANSPORT DEVICE AND IMAGE READING APPARATUS

(71) Applicant: SEIKO EPSON CORPORATION, Tokyo (JP)

(72) Inventors: Koji Migita, Kitakyushu (JP); Seiji Kawabata, Nagano (JP)

(73) Assignee: SEIKO EPSON CORPORATION, Tokyo (JP)

( * ) Notice: Subject to any disclaimer, the term of this patent is extended or adjusted under 35 U.S.C. 154(b) by 231 days.

(21) Appl. No.: 17/082,875

(22) Filed: Oct. 28, 2020

(65) Prior Publication Data

US 2021/0130119 A1 May 6, 2021

(30) Foreign Application Priority Data

Oct. 31, 2019 (JP) ..... JP2019-198921

(51) Int. Cl.
*B65H 3/06* (2006.01)
*B65H 3/56* (2006.01)
*B65H 3/34* (2006.01)

(52) U.S. Cl.
CPC ..... *B65H 3/56* (2013.01); *B65H 3/0684* (2013.01); *B65H 3/34* (2013.01); *B65H 2405/1134* (2013.01)

(58) Field of Classification Search
CPC ..... B65H 3/565; B65H 3/0684
See application file for complete search history.

(56) References Cited

U.S. PATENT DOCUMENTS 4,822,023 A * 4/1989 Miyoshi ..... B65H 3/56 271/118
6,199,855 B1 * 3/2001 Choeng ..... B65H 3/565 271/244
8,042,800 B2 * 10/2011 Hsu ..... B65H 3/34 271/121
2006/0038339 A1 2/2006 Shimamura

FOREIGN PATENT DOCUMENTS

JP 2006056690 A 3/2006
JP 2018104139 A 7/2018
JP 2018184253 A * 11/2018 ..... B65H 3/0676

OTHER PUBLICATIONS

Translation of JP-2018184253-A (Year: 2018).*
Office Action CN CN202011183759.X dated Jul. 1, 2022.

* cited by examiner

*Primary Examiner* — Howard J Sanders
(74) *Attorney, Agent, or Firm* — Chip Law Group

(57) ABSTRACT

A medium transport device includes a feeding unit that can be disposed at a contact position and a retracted position, a first restriction member that rotates between a restriction position and a release position, and a transport guide positioned on a side opposite to the feeding unit with a transport path interposed therebetween. When the first restriction member is positioned at the restriction position, the first restriction member maintains a state in which the feeding unit is positioned at the retracted position by the tip end contacting the feeding unit. When the first restriction member is positioned at the restriction position, the tip end thereof is positioned closer to the mounting portion side than the position of the rotation axis of the first restriction member in the transport direction.

20 Claims, 13 Drawing Sheets

Z

X

Z

X

MEDIUM TRANSPORT DEVICE AND IMAGE READING APPARATUS

The present application is based on, and claims priority from JP Application Serial Number 2019-198921, filed Oct. 31, 2019, the disclosure of which is hereby incorporated by reference herein in its entirety.

BACKGROUND

1. Technical Field

The present disclosure relates to a medium transport device that transports a medium and an image reading apparatus that reads an image from the medium transported by the medium transport device.

2. Related Art

JP-A-2006-56690 describes an example of a medium transport device that transports a document to a downstream in a transport direction. The medium transport device includes a feeding unit that feeds the medium mounted on a mounting portion to a downstream in the transport direction. The feeding unit includes a roller. The feeding unit is configured to be displaceable between a contact position where the roller can contact the medium mounted on the mounting portion and a retracted position where the roller cannot contact the medium. When the roller is brought into contact with the medium mounted on the mounting portion due to the displacement of the feeding unit from the retracted position to the contact position, the medium is fed from the mounting portion by rotating the roller.

The medium transport device described in JP-A-2006-56690 includes a restriction member that restricts a movement of the medium mounted on the mounting portion to the downstream in the transport direction. The restriction member is rotatable around a rotation axis extending in a width direction of the medium. Then, when the restriction member is disposed at a restriction position, since a tip end of the medium mounted on the mounting portion contacts the restriction member, the movement of the medium from the mounting portion to the downstream in the transport direction is restricted. On the other hand, when the restriction member is disposed at a release position different from the restriction position, since the tip end of the medium mounted on the mounting portion cannot be brought into contact with the restriction member, the restriction on the movement of the medium from the mounting portion to the downstream in the transport direction is released. When the restriction member is disposed at the release position, the tip end of the restriction member is positioned downstream in the transport direction as compared with the case where the restriction member is disposed at the restriction position.

When the restriction member is positioned at the restriction position, the tip end of the restriction member contacts the feeding unit and the restriction member supports the feeding unit. With this configuration, the state in which the feeding unit is positioned at the retracted position is maintained. When the restriction member is rotated from the restriction position to the retracted position in this state, since the tip end of the restriction member is not brought into contact with the feeding unit, the feeding unit is not supported by the restriction member. As a result, the feeding unit is displaced from the retracted position toward the contact position.

A large number of media may be mounted in a state of being stacked on the mounting portion. When the restriction member is disposed at the restriction position in this state, the restriction member may receive a load from a large number of media mounted on the mounting portion. In this case, when the load that the restriction member receives from the medium is large, there is a concern that the restriction member rotates from the restriction position toward the release position due to the load and the feeding unit cannot be maintained in a state in which the feeding unit is positioned at the retracted position.

SUMMARY

According to an aspect of the present disclosure for solving the problems described above, there is provided a medium transport device that transports a medium along a transport path, including a mounting portion that includes a mounting surface on which the medium is mounted, a feeding unit that includes a feeding roller feeding the medium mounted on the mounting surface to a downstream in a transport direction and is configured to be disposed at a contact position at which the feeding roller contacts the mounting surface and a retracted position at which the feeding roller is separated from the mounting surface and contact between the medium mounted on the mounting surface and the feeding roller is disabled, and a restriction member that, when a width direction of the medium mounted on the mounting surface is a medium width direction, the width direction intersecting the transport direction, rotates between a restriction position and a release position around a rotation axis that extends in the medium width direction and is disposed downstream of the mounting portion in the transport direction, and a transport guide positioned on a side opposite to the feeding unit with the transport path interposed therebetween. The release position is a position where a tip end of the restriction member is disposed downstream in the transport direction, as compared with a case where the restriction member is positioned at the restriction position. When the restriction member is positioned at the restriction position, the restriction member maintains a state in which the feeding unit is positioned at the retracted position and restricts a movement of the medium mounted on the mounting surface to the downstream in the transport direction, and when the restriction member is positioned at the release position, the restriction member allows displacement of the feeding unit to the contact position and allows a movement of the medium mounted on the mounting surface to the downstream in the transport direction. When the restriction member is positioned at the restriction position, the tip end of the restriction member is positioned closer to a mounting portion side than a position of the rotation axis in the transport direction in the transport path.

According to another aspect of the present disclosure for solving the problems described above, there is provided a medium transport device that transports a medium along a transport path, including a mounting portion that includes a mounting surface on which the medium is mounted, a feeding unit that includes a feeding roller feeding the medium mounted on the mounting surface to a downstream in a transport direction and is configured to be disposed at a contact position at which the feeding roller contacts the mounting surface and a retracted position at which the feeding roller is separated from the mounting surface and contact between the medium mounted on the mounting surface and the feeding roller is disabled, and, when a width direction of the medium mounted on the mounting surface is a medium width direction, the width direction intersecting the transport direction, a restriction member that rotates between a restriction position and a release position around a rotation axis that extends in the medium width direction and is disposed downstream of the mounting portion in the transport direction, and a transport guide positioned on a side opposite to the feeding unit with the transport path interposed therebetween. The release position is a position where a tip end of the restriction member is disposed downstream in the transport direction, as compared with a case where the restriction member is positioned at the restriction position. When the restriction member is positioned at the restriction position, the restriction member maintains a state in which the feeding unit is positioned at the retracted position, and restricts a movement of the medium mounted on the mounting surface to the downstream in the transport direction, and when the restriction member is positioned at the release position, the restriction member allows displacement of the feeding unit to the contact position and allows a movement of the medium mounted on the mounting portion to the downstream in the transport direction. A contact target is provided with a restricting recess in which the tip end of the restriction member is accommodated when the restriction member is positioned at the restriction position.

According to another aspect of the present disclosure for solving the problems described above, there is provided a medium transport device that transports a medium along a transport path, including a mounting portion that includes a mounting surface on which the medium is mounted, a feeding unit that includes a feeding roller feeding the medium mounted on the mounting surface to a downstream in a transport direction and is configured to be disposed at a contact position at which the feeding roller contacts the mounting surface and a retracted position at which the feeding roller is separated from the mounting surface and contact between the medium mounted on the mounting surface and the feeding roller is disabled, when a width direction of the medium mounted on the mounting surface is a medium width direction, the width direction intersecting the transport direction, a restriction member that rotates between a restriction position and a release position around a rotation axis that extends in the medium width direction and is disposed downstream of the mounting portion in the transport direction, and a transport guide positioned on a side opposite to the feeding unit with the transport path interposed therebetween. The release position is a position where a tip end of the restriction member is disposed downstream in the transport direction, as compared with a case where the restriction member is positioned at the restriction position. When the restriction member is positioned at the restriction position, the restriction member maintains a state in which the feeding unit is positioned at the retracted position, and restricts a movement of the medium mounted on the mounting surface to the downstream in the transport direction, and when the restriction member is positioned at the release position, the restriction member allows displacement of the feeding unit to the contact position and allows a movement of the medium mounted on the mounting portion to the downstream in the transport direction. The contact target is provided with a restricting protrusion with which the tip end of the restriction member comes into contact from an upstream in the transport direction when the restriction member is positioned at the restriction position.

According to another aspect of the present disclosure for solving the problems described above, there is provided an image reading apparatus including the medium transport device and a reading portion that reads an image of a medium transported by the medium transport device.

DESCRIPTION OF EXEMPLARY EMBODIMENTS

First Embodiment

Hereinafter, a first embodiment of a medium transport device and an image reading apparatus will be described with reference to FIGS. 1 to 12.

Figure 1:
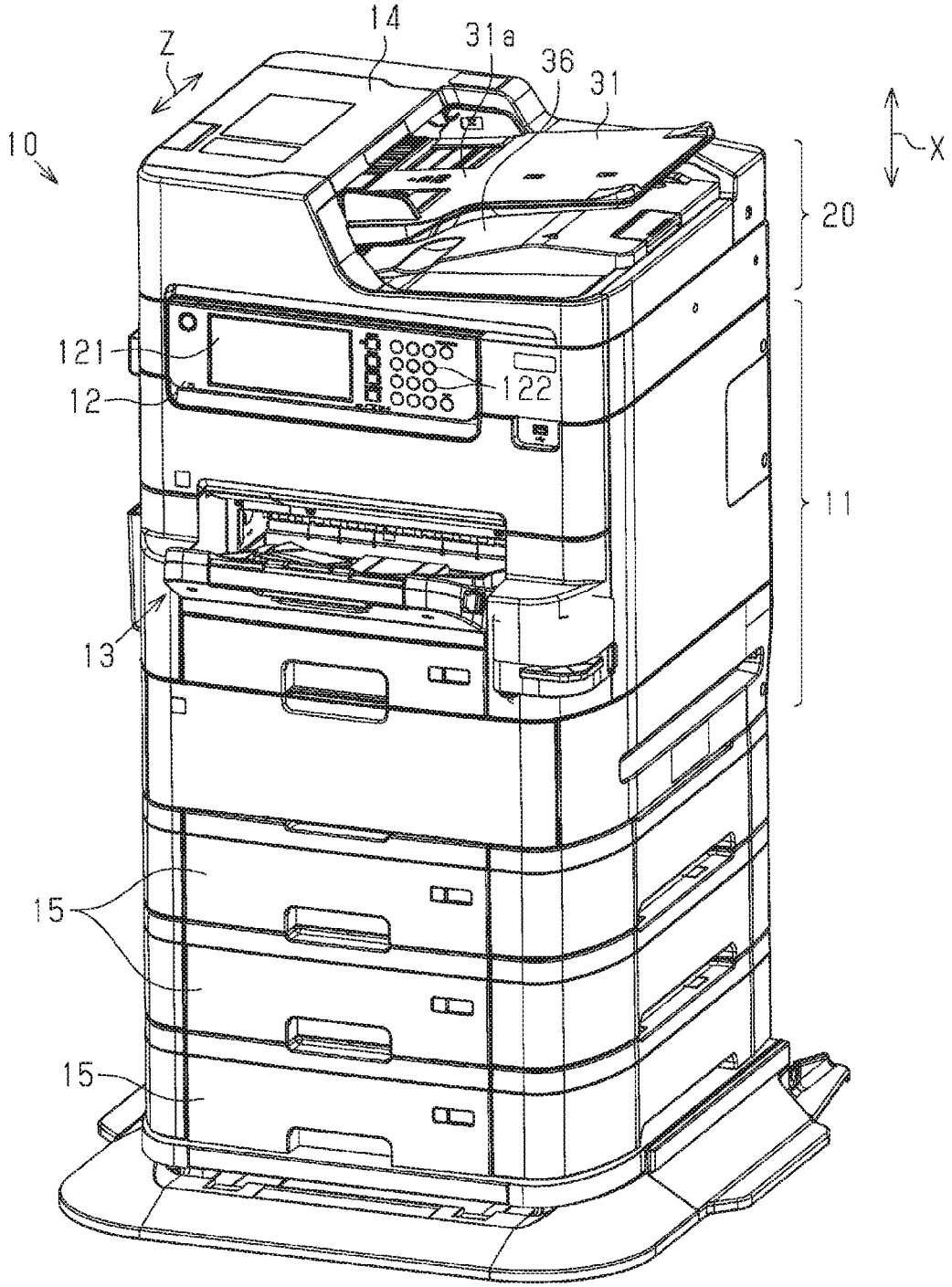
FIG. 1 is a perspective view illustrating a multifunction peripheral including an image reading apparatus according to a first embodiment.

FIG. 1 illustrates a multifunction peripheral 10 including an image reading apparatus 20 of this embodiment. The multifunction peripheral 10 includes a printing apparatus 11 in addition to the image reading apparatus 20. The printing apparatus 11 prints on a printing medium such as a paper sheet.

Figure 2:
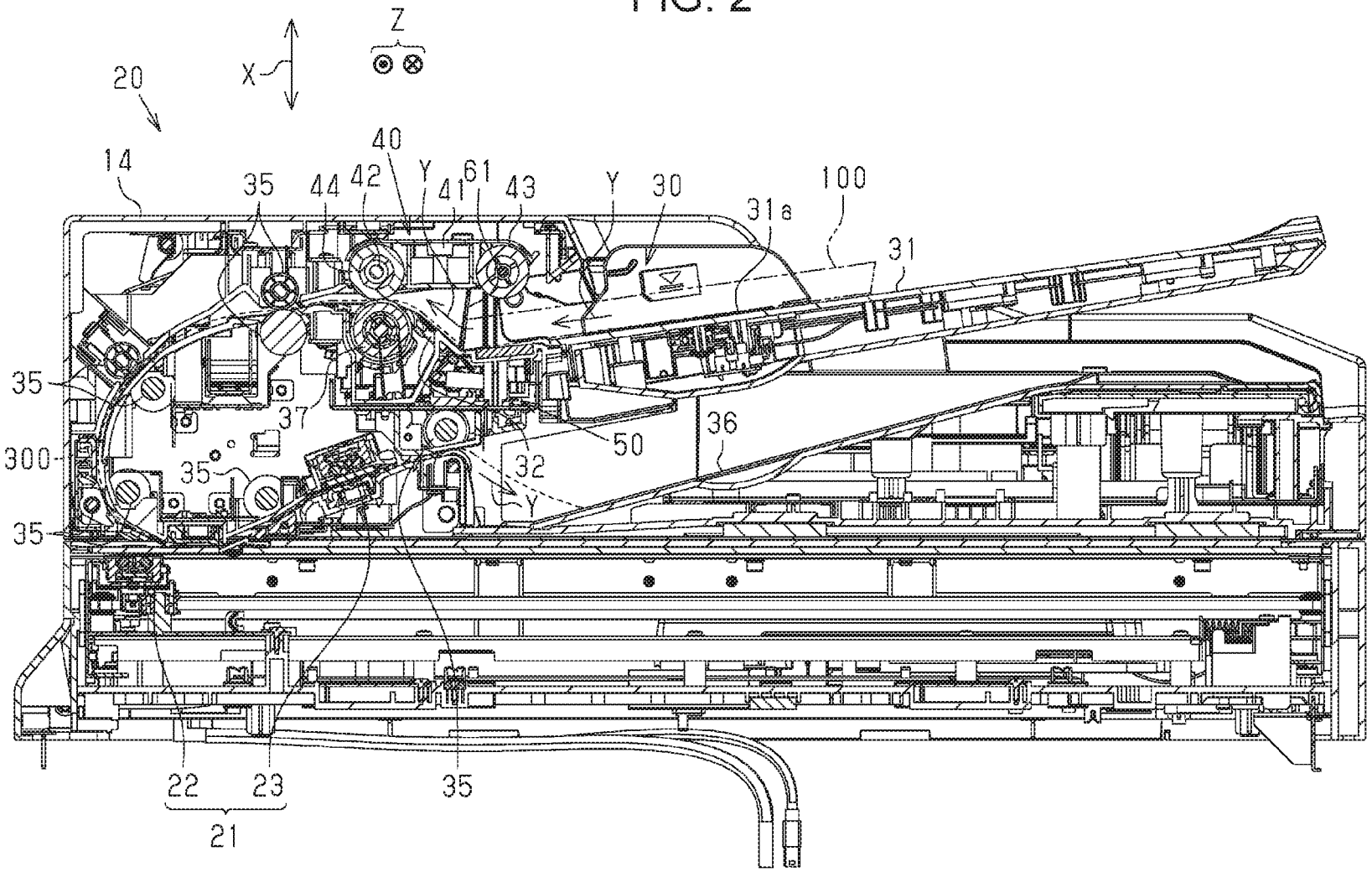
FIG. 2 is a cross-sectional view illustrating the image reading apparatus.

The multifunction peripheral 10 includes a user interface 12 operated by a user and a discharge tray 13. The user interface 12 is provided with a touch panel 121 and a plurality of buttons 122. The printing medium printed by the printing apparatus 11 is discharged to the discharge tray 13. The image reading apparatus 20 includes a reading portion cover 14. As illustrated in FIGS. 1 and 2, the reading portion cover 14 is attached to the image reading apparatus 20 in a rotatable state between an open position and a closed position. When the reading portion cover 14 is positioned at the closed position, a transport path 300 of a medium 100 in a medium transport device 30 described later cannot be visually recognized from the outside by the reading portion cover 14. On the other hand, when the reading portion cover 14 is positioned at the open position, the transport path 300 can be visually recognized from the outside. In FIGS. 1 and 2, the reading portion cover 14 is disposed at the closed position.

Below the printing apparatus 11 in the multifunction peripheral 10, a plurality of cassettes 15 for accommodating printing media are provided. In the example illustrated in FIG. 1, the plurality of cassettes 15 are stacked, and the printing apparatus 11 is disposed on the uppermost cassette 15.

Next, the image reading apparatus 20 will be described.

As illustrated in FIG. 2, the image reading apparatus 20 includes the medium transport device 30 that transports the medium 100 such as a document along a transport path 300 illustrated by a broken line in FIG. 2, and a reading device 21 that reads an image from the medium 100 transported by the medium transport device 30 and generates image data. The reading device 21 includes a first reading portion 22 that reads an image on a front surface of the medium 100 transported along the transport path 300 and a second reading portion 23 that reads an image on a back surface of the medium 100. Examples of the first reading portion 22 and the second reading portion 23 may include a contact optical-type sensor. A reduction optical-type sensor may be adopted as the first reading portion 22.

The medium transport device 30 includes a mounting portion 31 on which the medium 100 before the image is read is mounted. It is possible to place a plurality of media 100 in a stacked state on the mounting surface 31*a* of the mounting portion 31. When a direction orthogonal to a surface on which the multifunction peripheral 10 is installed is a vertical direction X, the mounting surface 31*a* is inclined with respect to the vertical direction X. Specifically, on the mounting surface 31*a*, the mounting surface 31*a* is inclined with respect to the vertical direction X so that a portion at the downstream in a transport direction Y is positioned below a portion at the upstream in the vertical direction X.

The medium transport device 30 includes a feeding unit 40 that sends out the uppermost medium 100 of the plurality of media 100 mounted on the mounting surface 31*a* to the transport path 300 and a transport guide 32 positioned on a side opposite to the feeding unit 40 with the transport path 300 interposed therebetween. The medium transport device 30 includes a plurality of rollers 35 disposed downstream of the feeding unit 40 in the transport direction Y. Then, by the rotation of each of the rollers 35, the medium 100 is transported to the downstream in the transport direction Y along the transport path 300.

The medium transport device 30 includes a discharger 36 for discharging the medium 100 whose images are read by the reading portions 22 and 23.

In the following description, a width direction of the medium 100 mounted on the mounting surface 31*a* is referred to as a medium width direction Z. In the image reading apparatus 20 of this embodiment, the medium width direction Z is orthogonal to the transport direction Y of the medium 100. However, the medium width direction Z only needs to intersect the transport direction Y, and the medium width direction Z does not need to be orthogonal to the transport direction Y.

Figure 3:
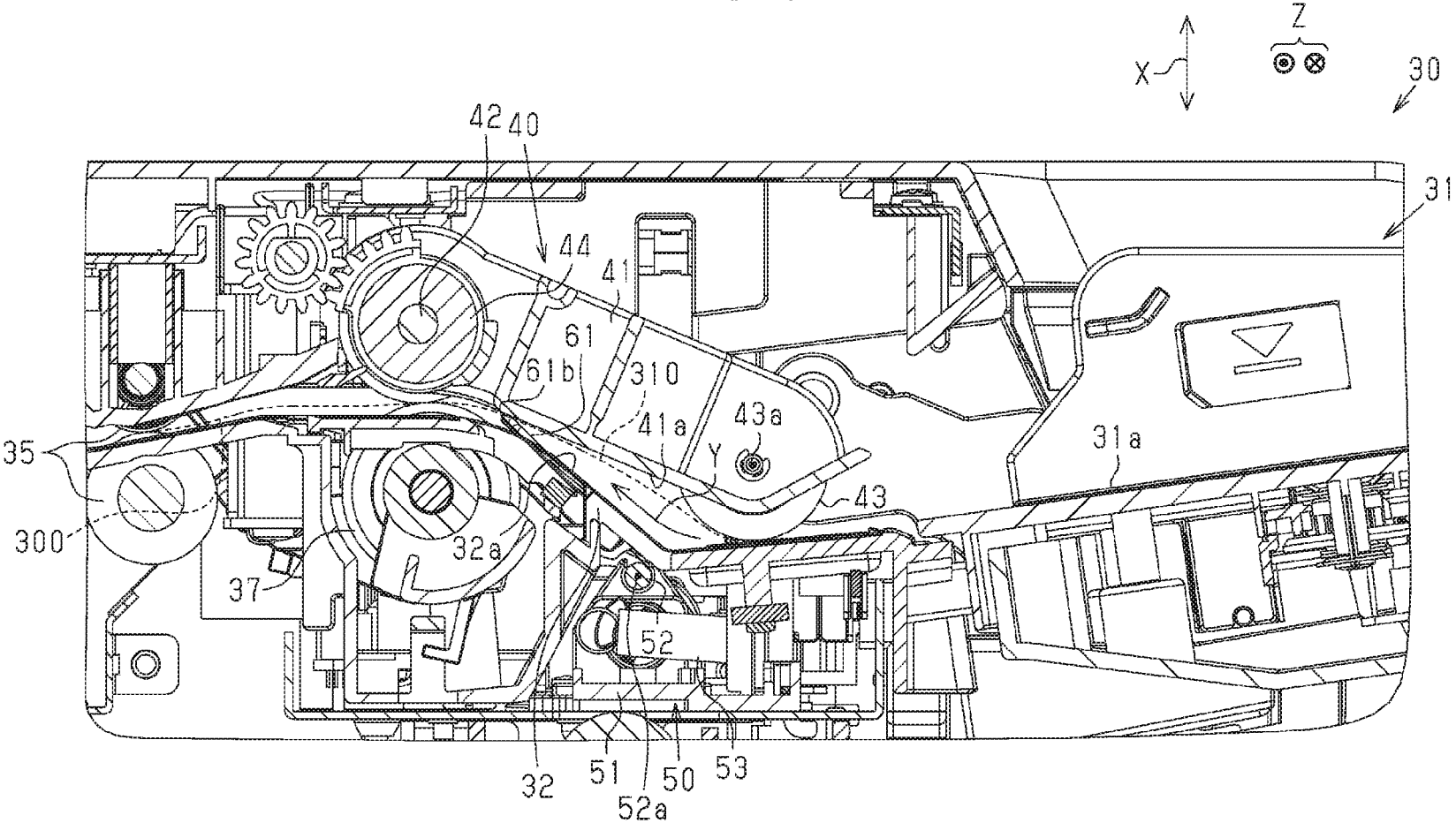
FIG. 3 is an enlarged cross-sectional view of a part of the image reading apparatus.

As illustrated in FIGS. 2 and 3, the feeding unit 40 includes a feeding unit main body 41 positioned at the center of the transport path 300 in the medium width direction Z. The feeding unit main body 41 is attached to the reading portion cover 14 of the image reading apparatus 20 in a rotatable state via a unit rotation shaft 42 extending in the medium width direction Z. The unit rotation shaft 42 is disposed downstream of the mounting portion 31 in the transport direction Y. The feeding unit main body 41 extends upstream in the transport direction Y from the portion supported by the unit rotation shaft 42.

Figure 4:
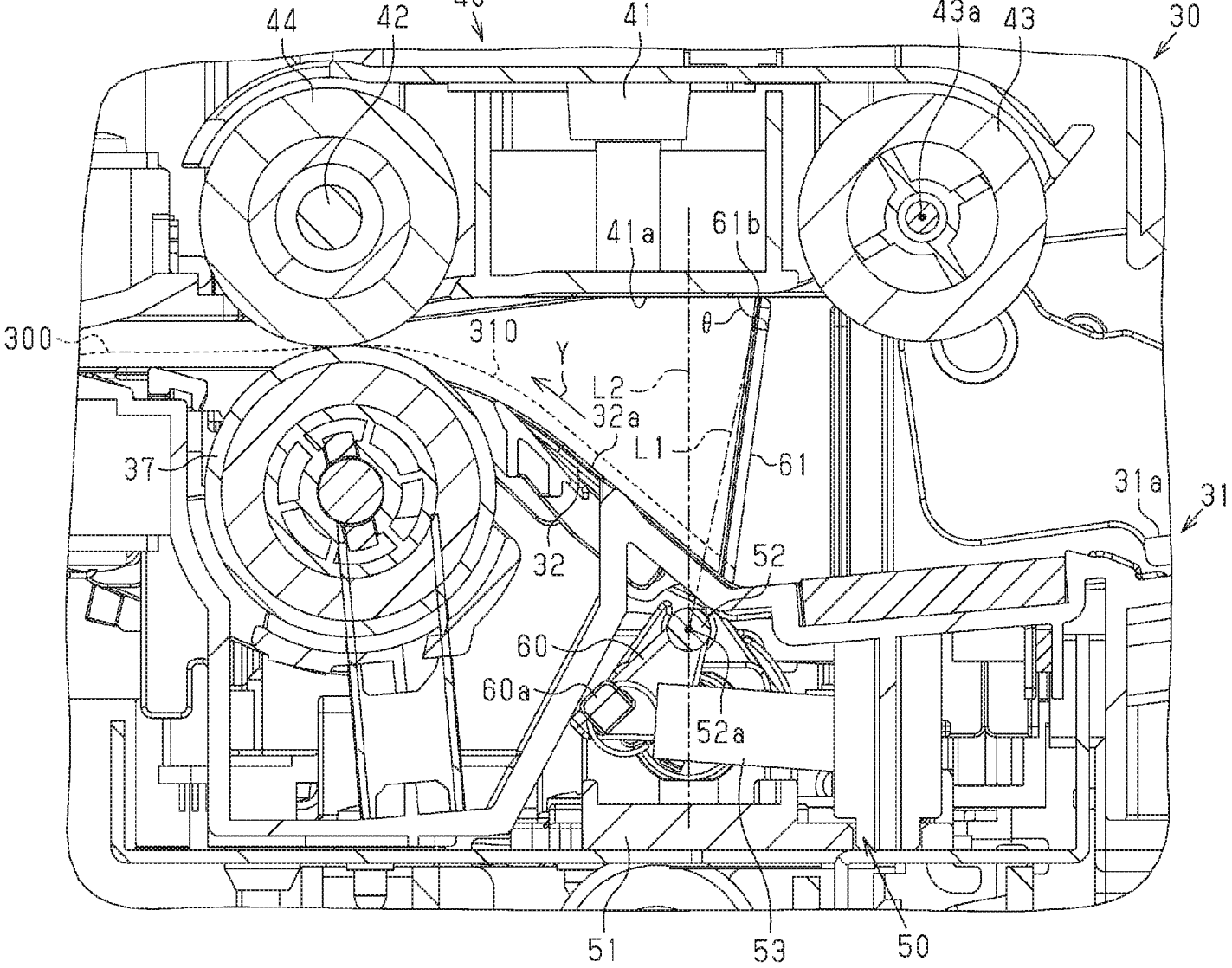
FIG. 4 is an enlarged cross-sectional view of a part of the image reading apparatus.

As illustrated in FIGS. 3 and 4, the feeding unit 40 includes a feeding roller 43 supported by the feeding unit main body 41 in a rotatable state. The feeding roller 43 rotates around a rotation axis 43*a* extending in the medium width direction Z. The feeding roller 43 is disposed upstream of the unit rotation shaft 42 in the transport direction Y. The feeding roller 43 can contact the medium 100 mounted on the mounting surface 31*a*.

The feeding unit 40 preferably includes a separation roller 44 disposed downstream of the feeding roller 43 in the transport direction Y. In this case, the separation roller 44 is capable of rotating around a rotation axis extending in the medium width direction Z and contacting the medium 100 transported along the transport path 300. That is, the separation roller 44 can sandwich the medium 100 together with a retard roller 37 supported by the image reading apparatus 20.

The retard roller 37 rotates when a torque equal to or larger than a predetermined value is input, but does not rotate when the input torque is less than the predetermined value. For that reason, when the plurality of media 100 are transported in an overlapping manner, the separation roller 44 and the retard roller 37 can eliminate the state in which the plurality of media 100 are transported in an overlapping manner.

In this embodiment, the separation roller 44 is supported by the unit rotation shaft 42 in a rotatable state. However, the separation roller 44 may be positioned downstream of the feeding roller 43 in the transport direction Y, and may not be supported by the unit rotation shaft 42.

A unit section surface 41*a* facing the transport path 300 is provided downstream of the feeding roller 43 in the feeding unit main body 41 in the transport direction Y. When the feeding unit 40 is provided with the separation roller 44, the unit section surface 41*a* is disposed between the feeding roller 43 and the separation roller 44 in the transport direction Y. When the medium 100 is transported to the downstream in the transport direction Y, the unit section surface 41*a* opposes to the medium 100.

A portion of the transport path 300 that is divided by the portion of the transport guide 32 opposed to the feeding unit 40 is referred to as an upstream transport path 310. That is, it can be said that the upstream transport path 310 is a portion of the transport path 300 between a downstream end of the feeding unit 40 in the transport direction Y and a downstream end of the mounting portion 31 in the transport direction Y. A surface of the transport guide 32 facing the upstream transport path 310 is referred to as a path section surface 32*a*.

The feeding unit main body 41 rotates integrally with the unit rotation shaft 42. That is, by rotating the feeding unit main body 41, the feeding roller 43 can be brought closer to the mounting portion 31, or the feeding roller 43 can be separated from the mounting portion 31. The feeding unit 40 can be disposed at both the contact position illustrated in FIG. 3 and the retracted position illustrated in FIG. 4. The contact position is a position of the feeding unit 40 where the feeding roller 43 is brought into contact with the mounting surface 31*a*. On the other hand, the retracted position is a position of the feeding unit 40 where the feeding roller 43 is separated from the mounting surface 31*a*. When the feeding unit 40 is disposed in the retracted position, the feeding roller 43 is not brought into contact with the medium 100 mounted on the mounting surface 31*a*.

As illustrated in FIGS. 3 and 4, the medium transport device 30 includes a restriction portion 50 that restricts the feeding of the medium 100 mounted on the mounting portion 31 to the downstream in the transport direction Y. The restriction portion 50 includes a restriction portion main body 51 disposed on a side opposite to the upstream transport path 310 with the transport guide 32 interposed therebetween, a restricting rotation shaft 52 supported by the restriction portion main body 51 in a rotatable state, and a rotating spring 53 attached to the restriction portion main body 51 and the restricting rotation shaft 52. That is, in this embodiment, the restricting rotation shaft 52 is disposed on a side opposite to the upstream transport path 310 with the transport guide 32 interposed therebetween. In this embodiment, the restricting rotation shaft 52 extends in the medium width direction Z.

Figure 5:
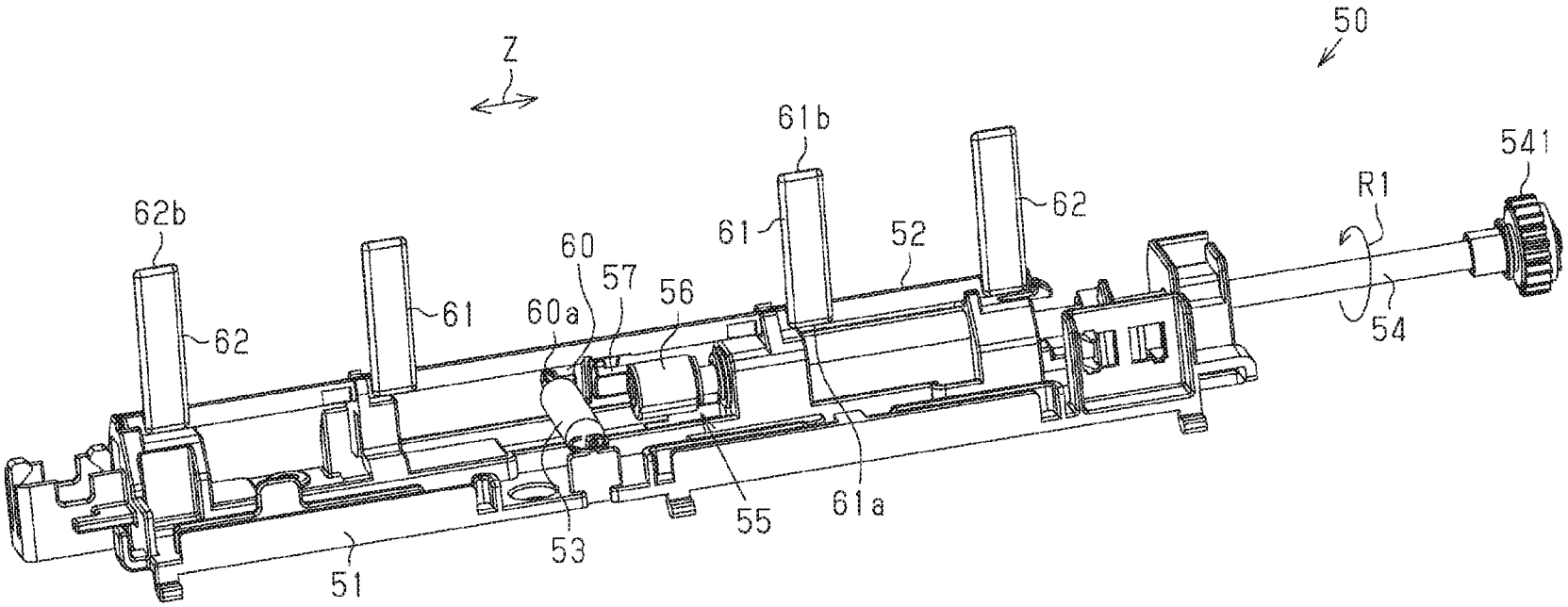
FIG. 5 is a perspective view illustrating a restriction portion of the image reading apparatus.
Figure 6:
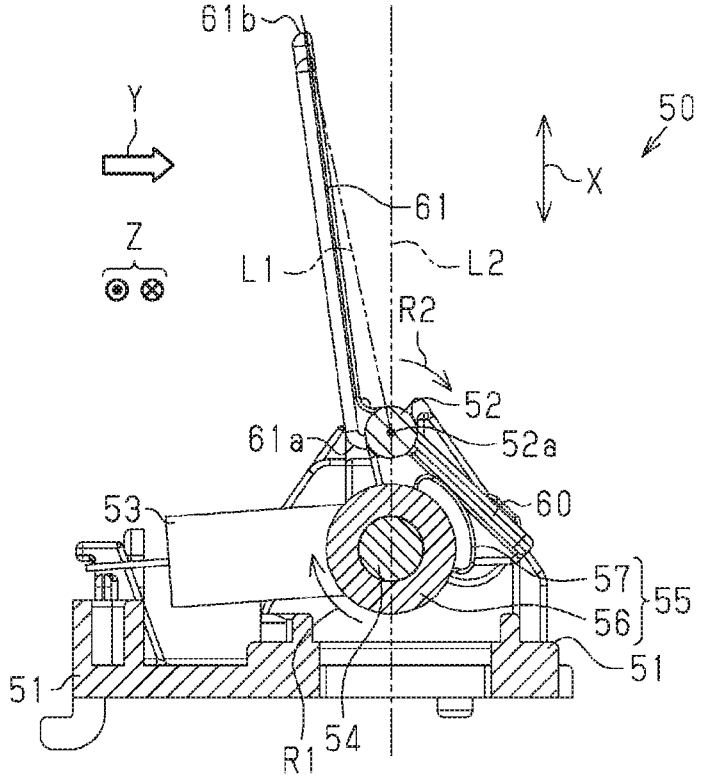
FIG. 6 is a cross-sectional view of the restriction portion.

As illustrated in FIG. 5, the restriction portion main body 51 is fixed to the image reading apparatus 20 in a manner extending in the same direction as the restricting rotation shaft 52. The extending direction of the restriction portion main body 51 may be slightly deviated from the extending direction of the restricting rotation shaft 52. The restriction portion main body 51 supports a restricting drive shaft 54 extending in the same direction as the extending direction of the restricting rotation shaft 52 in a rotatable state. As illustrated in FIGS. 5 and 6, the restricting drive shaft 54 rotates in a predetermined rotation direction R1. In the extending direction of the restriction portion main body 51, a first end of the restricting drive shaft 54 is positioned outside a first end of the restriction portion main body 51. On the other hand, a second end of the restricting drive shaft 54 is positioned between the first end and the second end of the restriction portion main body 51 in the extending direction of the restriction portion main body 51. A drive gear 541 is attached to an end portion of the restricting drive shaft 54 on the first end side. On the other hand, a rotation restricting portion 55 is attached to an end portion of the restricting drive shaft 54 on the second end side.

The rotation restricting portion 55 is supported by the restricting drive shaft 54 so as to be integrally rotatable. The rotation restricting portion 55 includes a cylindrical inserted portion 56 through which the restricting drive shaft 54 is inserted, and a protruding portion 57 attached to a radially outer surface of the inserted portion 56.

The force from the rotating spring 53 acts on the restricting rotation shaft 52 in the direction of rotating the restricting rotation shaft 52 in a release rotation direction R2 illustrated in FIG. 6. However, when the protruding portion 57 of the rotation restricting portion 55 is positioned at the position illustrated in FIG. 6, the protruding portion 57 is brought into contact with a pressed portion 60 provided on the restricting rotation shaft 52, which will be described later, thereby causing the rotation of the restricting rotation shaft 52 to be restricted. On the other hand, when the protruding portion 57 is not in contact with the pressed portion 60, the rotation of the restricting rotation shaft 52 in the release rotation direction R2 caused by the force from the rotating spring 53 is allowed.

The pressed portion 60 is coupled to the restricting rotation shaft 52 in a state of being integrally rotatable. The pressed portion 60 is a plate-shaped part that extends along the extending direction of the restricting rotation shaft 52. As illustrated in FIG. 5, the pressed portion 60 is provided with a support portion 60*a* that supports the rotating spring 53. For that reason, the force from the rotating spring 53 is input to the pressed portion 60. The pressed portion 60 contacts the protruding portion 57. When a rotation angle of the restricting drive shaft 54 is maintained and the protruding portion 57 is in contact with the pressed portion 60, the rotation of the pressed portion 60 and the restricting rotation shaft 52 in the release rotation direction R2 is restricted. On the other hand, when the protruding portion 57 is not in contact with the pressed portion 60, the force input from the rotating spring 53 to the pressed portion 60 causes the pressed portion 60 and the restricting rotation shaft 52 to rotate in the release rotation direction R2.

The restricting rotation shaft 52 supports the restriction member so as to be integrally rotatable. That is, the restriction member is disposed downstream of the mounting portion 31 in the transport direction Y. In this embodiment, a plurality of first restriction members 61 are coupled to the restricting rotation shaft 52 as restriction members. As illustrated in FIG. 5, each first restriction member 61 has a plate shape extending in one direction. The first end of each first restriction member 61 in the longitudinal direction is coupled to the restricting rotation shaft 52. Thus, the first end of each first restriction member 61 corresponds to a base end 61*a* of the first restriction member 61, and the second end of each first restriction member 61 corresponds to a tip end 61*b* of the first restriction member 61.

Figure 8:
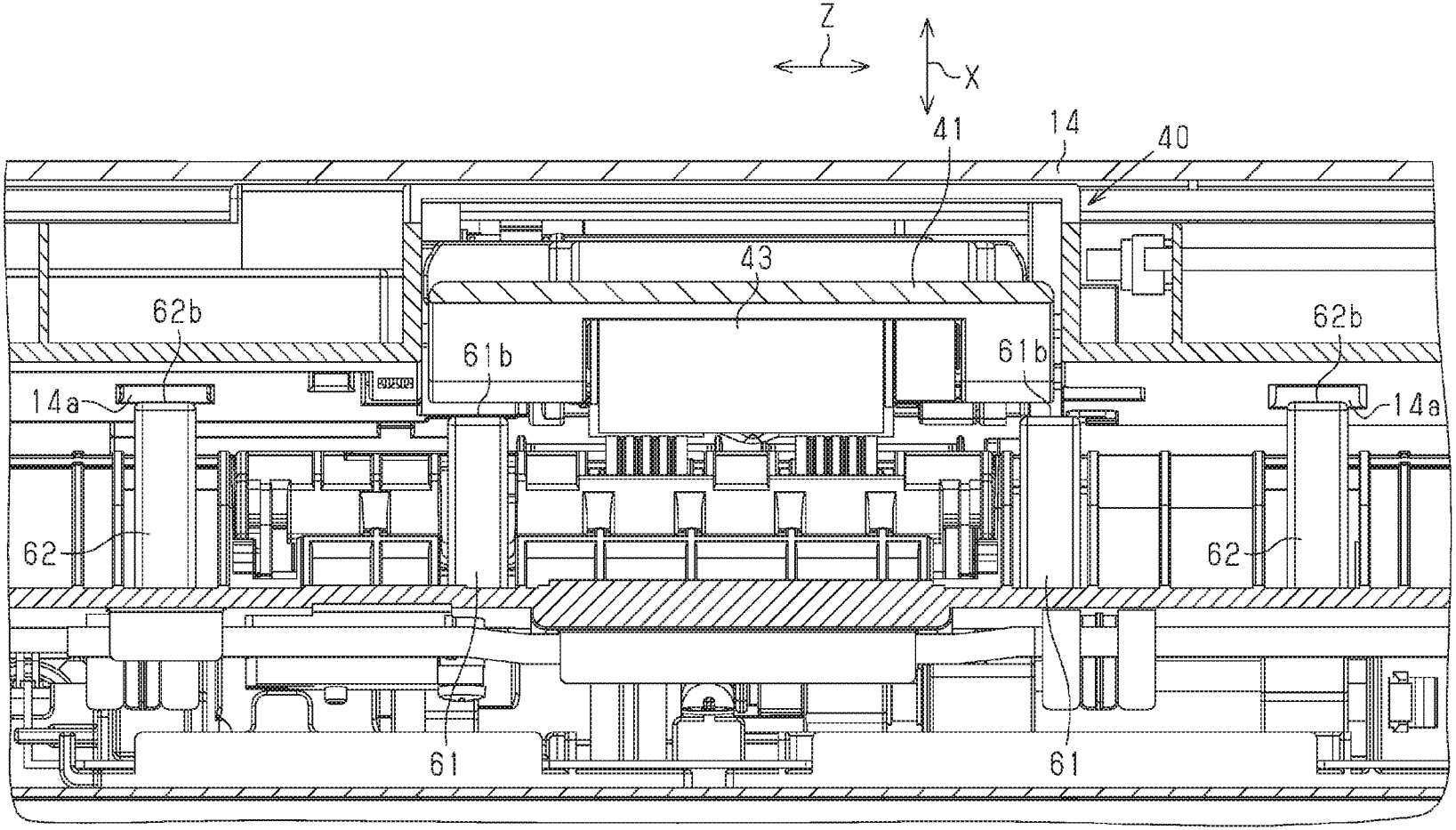
FIG. 8 is a cross-sectional view illustrating a part of the image reading apparatus.

As illustrated in FIG. 8, each first restriction member 61 is disposed between the first end and the second end of the feeding unit main body 41 in the medium width direction Z. Each first restriction member 61 rotates between the restriction position illustrated in FIGS. 4 and 6 and the release position illustrated in FIG. 3. When each first restriction member 61 is positioned at the restriction position, the protruding portion 57 is in contact with the pressed portion 60 as illustrated in FIG. 6. Then, if the restricting drive shaft 54 rotates when each first restriction member 61 is positioned at the restriction position, the protruding portion 57 also rotates, and thus contact between the protruding portion 57 and the pressed portion 60 is eliminated. Then, the restricting rotation shaft 52 rotates in the release rotation direction R2 by the force input from the rotating spring 53 to the pressed portion 60. As a result, each first restriction member 61 rotates from the restriction position toward the release position. Then, when each first restriction member 61 is positioned at the release position, the protruding portion 57 is not in contact with the pressed portion 60. That is, in this embodiment, the rotation of each first restriction member 61 can be adjusted by controlling the position of the protruding portion 57.

As illustrated in FIG. 4, when each first restriction member 61 is positioned at the restriction position, the tip end of the medium 100 mounted on the mounting portion 31 contacts each first restriction member 61. As a result, the movement of the medium 100 mounted on the mounting surface 31*a* to the downstream in the transport direction Y is restricted. When each first restriction members 61 is positioned at the restriction position, the tip end 61*b* of each first restriction members 61 is brought into contact with the feeding unit 40 positioned at the retracted position. Specifically, the tip end 61*b* of each first restriction member 61 contacts the unit section surface 41*a* of the feeding unit 40.

With this configuration, the state in which the feeding unit 40 is positioned at the retracted position is maintained. That is, in this embodiment, the feeding unit 40 corresponds to the "contact target".

On the other hand, as illustrated in FIG. 3, when each first restriction member 61 is positioned at the release position, the tip end 61*b* of each first restriction member 61 is positioned downstream in the transport direction Y as compared with the case where each first restriction member 61 is positioned at the restriction position. In this case, the restriction on the movement of the medium 100 mounted on the mounting surface 31*a* to the downstream in the transport direction Y is released. When each first restriction member 61 is positioned at the release position, the tip end 61*b* of each first restriction member 61 is not in contact with the feeding unit 40. For that reason, the state in which the feeding unit 40 is positioned at the retracted position is released by disposing each first restriction member 61 at the release position. As a result, the feeding unit 40 can be rotated from the retracted position toward the contact position.

Figure 7:
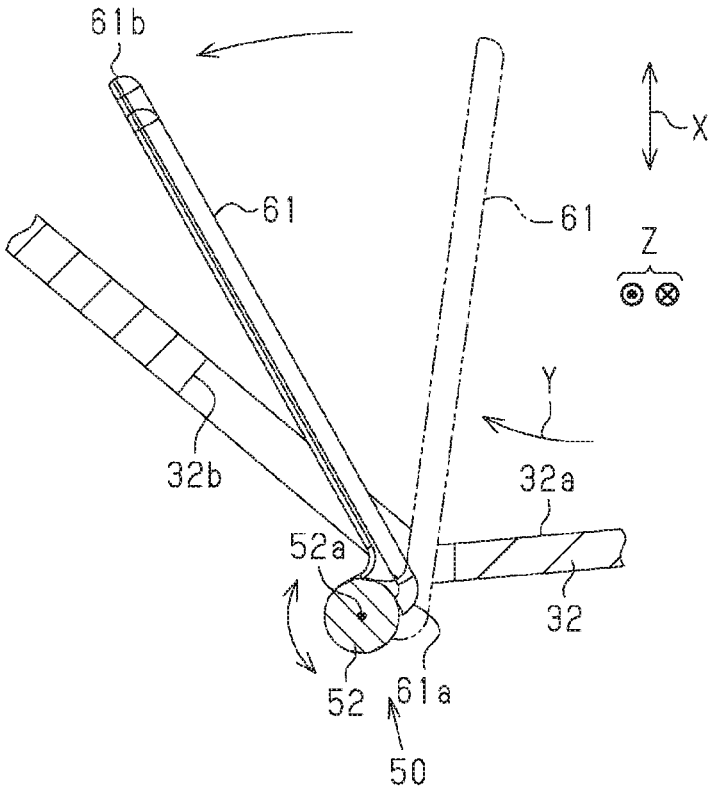
FIG. 7 is a cross-sectional view schematically illustrating a state in which a first restriction member is rotated from a restriction position to a release position in the image reading apparatus.

As illustrated by the solid line in FIG. 7, even when each first restriction member 61 is positioned at the release position, the tip end 61*b* of each first restriction member 61 is positioned in the upstream transport path 310. That is, a part of each first restriction member 61 is positioned in the upstream transport path 310. In this case, in the vertical direction X, the tip end 61*b* of each first restriction member 61 is preferably positioned closer to the path section surface 32*a* of the transport guide 32 than the unit section surface 41*a* of the feeding unit 40. With this configuration, a space through which the medium 100 passes can be secured between the tip end 61*b* of each first restriction member 61 and the unit section surface 41*a*.

As such, when the tip end 61*b* is disposed in the upstream transport path 310 even when each first restriction member 61 is positioned at the release position, it is preferable that the friction coefficient of the part opposed to the feeding unit 40 in the portion positioned on the upstream transport path 310 when the first restriction member 61 is positioned at the release position of each first restriction member 61 is made higher than a friction coefficient of the path section surface 32*a*. In this case, a process for increasing the friction coefficient may be applied to the part, or a seal material having a high friction coefficient may be adhered to the part.

As described above, the restricting rotation shaft 52 is positioned on the side opposite to the upstream transport path 310 with the transport guide 32 interposed therebetween, but the tip end 61*b* of each first restriction member 61 is positioned in the upstream transport path 310. For that reason, the transport guide 32 is provided with a first insertion hole 32*b* as an insertion hole through which the first restriction member 61 is inserted. Specifically, the transport guide 32 is provided with the same number of first insertion holes 32*b* as that of the first restriction members 61.

In this embodiment, as illustrated in FIG. 6, in a cross-section obtained by cutting the restricting rotation shaft 52 and the first restriction member 61 in the direction orthogonal to the medium width direction Z, the base end 61*a* of the first restriction member 61 is not positioned on the straight line L1 coupling a rotation axis 52*a* of the restricting rotation shaft 52 and the tip end 61*b* of the first restriction member 61. More specifically, when each first restriction member 61 is positioned at the restriction position, the coupling parts between the restricting rotation shaft 52 and the base end 61*a* of the first restriction member 61 are respectively positioned upstream of the rotation axis 52*a* of the restricting rotation shaft 52 in the transport direction Y. When each first restriction member 61 is positioned at the restriction position, the extending direction of the first restriction member 61 is inclined with respect to the vertical direction X. That is, the extending direction of the first restriction member 61 is inclined with respect to the vertical direction X in a mode in which the tip end 61*b* of the first restriction member 61 is positioned upstream of the base end 61*a* in the transport direction Y in the upstream transport path 310. Accordingly, when each first restriction member 61 is positioned at the restriction position, the tip end 61*b* of each first restriction member 61 is positioned closer to the mounting portion 31 side than the position of the rotation axis 52*a* of the restricting rotation shaft 52 in the transport direction Y in the upstream transport path 310. In this embodiment, the rotation axis 52*a* of the restricting rotation shaft 52 is also the rotation axis of each first restriction member 61.

As illustrated in FIG. 4, in the cross-section obtained by cutting the first restriction member 61 and the feeding unit 40 in the direction orthogonal to the medium width direction Z, an angle θ between a surface of the unit section surface 41*a* downstream of the contact part with the tip end 61*b* of the first restriction member 61 in the transport direction Y when the feeding unit 40 is positioned at the retracted position and the straight line L1 coupling the rotation axis 52*a*, which is the rotation axis of the first restriction member 61, and the tip end 61*b* is less than "90°".

As illustrated in FIG. 5, the restriction portion 50 preferably has second restriction members 62 as the restriction member. In this embodiment, the second restriction members 62 are respectively disposed on both sides of the first restriction members 61 in the medium width direction Z. Each second restriction member 62 is supported by the restricting rotation shaft 52 so as to be integrally rotatable. That is, each second restriction member 62 rotates around the rotation axis of each first restriction member 61. Each second restriction member 62 extends in one direction, similarly to each first restriction member 61. The second restriction member 62 is longer than the first restriction member 61. For that reason, the shortest distance from the rotation axis 52*a* of the restricting rotation shaft 52 to the tip end 62*b* of the second restriction member 62 is longer than the shortest distance from the rotation axis 52*a* to the tip end 61*b* of the first restriction member 61.

Then, when each first restriction member 61 is disposed at the restriction position, each second restriction member 62 is preferably also disposed at the restriction position, and when each first restriction member 61 is disposed at the release position, each second restriction member 62 is preferably also disposed at the release position. In this case, when each first restriction member 61 and each second restriction member 62 are respectively positioned at the restriction position, the second restriction members 62 can also restrict the movement of the medium 100 from the mounting portion 31 to the downstream in the transport direction Y. On the other hand, when the first restriction member 61 and the second restriction member 62 are respectively positioned at the release position, the restriction on the movement of the medium 100 from the mounting portion 31 to the downstream in the transport direction Y can be released.

When the second restriction members 62 are provided in the restriction portion 50 in this way, it is preferable to dispose the second restriction members 62 outside the feeding unit main body 41 in the medium width direction Z. In this case, as illustrated in FIG. 8, the reading portion cover 14 of the image reading apparatus 20 is provided with an accommodation recess 14*a* in which the tip end 62*b* of the second restriction member 62 is accommodated when each first restriction member 61 is positioned at the restriction position. When each first restriction member 61 rotates from the restriction position to the retracted position, each second restriction member 62 also rotates from the restriction position to the retracted position in synchronization with the rotation of each first restriction member 61. Incidentally, the transport guide 32 is also provided with a second insertion hole through which the second restriction member 62 is inserted.

Next, a power transmission system of the medium transport device 30 will be described with reference to FIG. 9.

For example, the medium transport device 30 includes a first motor 71 that is a power source of the feeding roller 43 and a second motor 72 that is a power source of the separation roller 44. The first motor 71 is configured in such a way that an output shaft thereof is rotatable in both forward and reverse directions. A first one-way clutch 73 is provided on a power transmission path from the first motor 71 to the feeding roller 43. The first one-way clutch 73 transmits a driving force of the first motor 71 to the feeding roller 43 when an output shaft of the first motor 71 rotates in the forward direction, but does not transmit the driving force of the first motor 71 to the feeding roller 43 when the output shaft rotates in the reverse direction. For that reason, when an output shaft of the first motor 71 rotates in the forward direction, the medium 100 mounted on the mounting portion 31 can be fed by the feeding roller 43. On the other hand, when the output shaft of the first motor 71 rotates in the reverse direction, the medium 100 mounted on the mounting portion 31 cannot be fed.

A first motor 71 may function as a power source of the restriction portion 50. In this case, a second one-way clutch 74 is provided on a power transmission path from the first motor 71 to the restriction portion 50. The second one-way clutch 74 does not transmit a driving force of the first motor 71 to the restricting drive shaft 54 when the output shaft of the first motor 71 rotates in the forward direction, but transmits the driving force of the first motor 71 to the restricting drive shaft 54 when the output shaft rotates in the reverse direction. For that reason, when the output shaft of the first motor 71 rotates in the forward direction, the restricting rotation shaft 52 cannot be rotated. On the other hand, when the output shaft of the first motor 71 rotates in the reverse direction, the restricting rotation shaft 52 can be rotated.

The output shaft of the second motor 72 is configured to be rotatable in both the forward and reverse directions. Then, by rotating the output shaft of the second motor 72 in the forward direction, the separation roller 44 rotates in a direction in which the medium 100 can be sent to the downstream in the transport direction Y. The driving force of the second motor 72 is also transmitted to each drive roller disposed downstream of the separation roller 44 in the transport direction Y.

The second motor 72 may function as a power source for displacing the feeding unit 40. In this case, it is preferable to dispose an electromagnetically driven clutch 75 in the power transmission path from the second motor 72 to the feeding unit 40. According to this, when the clutch 75 is in a disengagement state, the driving force of the second motor 72 is not transmitted to the unit rotation shaft 42 of the feeding unit 40. That is, when the clutch 75 is in the disengagement state, the unit rotation shaft 42 receives almost no load from various components on the power transmission path. For that reason, when each of the first restriction members 61 is positioned at the retracted position, the unit rotation shaft 42 can be rotated so that the feeding unit 40 approaches the contact position by its own weight. On the other hand, in the state in which the clutch 75 is in an engagement state, the driving force of the second motor 72 is transmitted to the unit rotation shaft 42.

Next, a control configuration of the image reading apparatus 20 will be described with reference to FIGS. 9 to 12.

Figure 9:
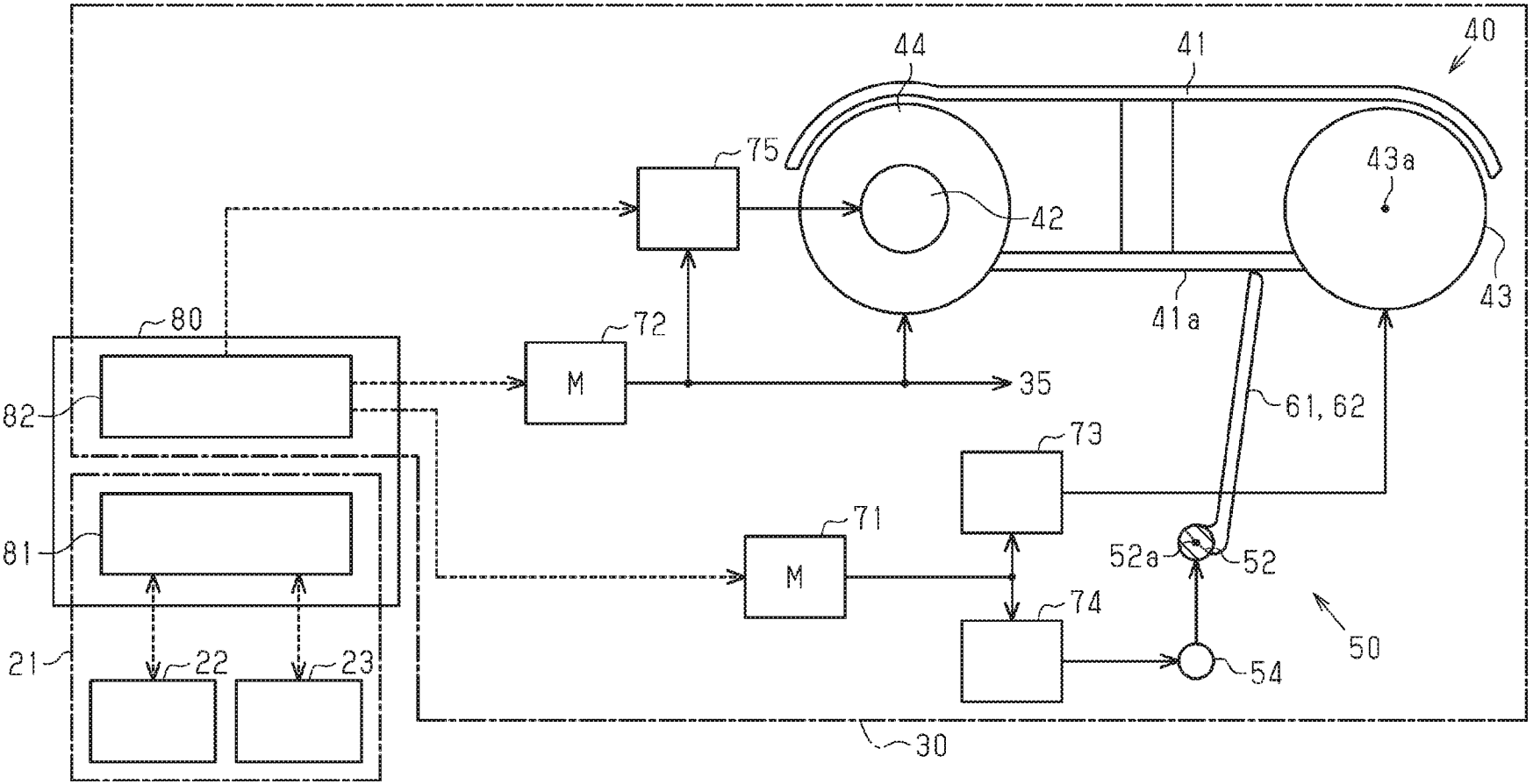
FIG. 9 is a block diagram illustrating an outline of the image reading apparatus.

As illustrated in FIG. 9, a control device 80 of the image reading apparatus 20 includes a reading controller 81 and a transport controller 82 as functional portions. The reading controller 81 controls a first reading portion 22 and a second reading portion 23. The reading controller 81 generates image data based on the images read by the reading portions 22 and 23. That is, the reading controller 81 constitutes the "reading device 21" together with the reading portions 22 and 23.

The transport controller 82 controls a first motor 71, a second motor 72, and a clutch 75. That is, when the restriction members 61 and 62 are disposed at the restriction positions to stop feeding of the medium 100 from the mounting portion 31, the transport controller 82 rotates the output shaft of the first motor 71 in the reverse direction. With this configuration, the driving force of the first motor 71 is transmitted to the restriction portion 50 via the second one-way clutch 74. As a result, the restricting drive shaft 54 and the protruding portion 57 of the restriction portion 50 rotate. Then, the protruding portion 57 is brought into contact with the pressed portion 60 and is pushed by the protruding portion 57, so that the restricting rotation shaft 52 rotates against the force from the rotating spring 53. As a result, the restriction members 61 and 62 rotate from the retracted position toward the restriction position. Then, when each of the restriction members 61 and 62 is disposed at the restriction position, the transport controller 82 stops the driving of the first motor 71.

In this case, the transport controller 82 puts the clutch 75 into the engagement state in order to rotate the feeding unit 40 to the retracted position, and then drives the second motor 72. With this configuration, the driving force of the second motor 72 is transmitted to the unit rotation shaft 42, and thus the unit rotation shaft 42 rotates. As a result, the feeding unit 40 rotates to the retracted position. Then, when the feeding unit 40 reaches the retracted position, the transport controller 82 stops the driving of the second motor 72. When the feeding unit 40 is positioned at the retracted position in this way, since the restriction members 61 and 62 are respectively disposed at the restriction positions, the transport controller 82 may bring the clutch 75 into the disengagement state or maintain the engagement state.

On the other hand, when the restriction members 61 and 62 are rotated from the restriction position to the release position to allow feeding of the medium 100 from the mounting portion 31, the transport controller 82 brings the clutch 75 into the disengagement state and then rotates the output shaft of the first motor 71 in the reverse direction. With this configuration, the driving force of the first motor 71 is transmitted to the restriction portion 50 via the second one-way clutch 74, and thus the restricting drive shaft 54 and the protruding portion 57 rotate. Then, contact between the protruding portion 57 and the pressed portion 60 is eliminated, and thus the restricting rotation shaft 52 is rotated by the force from the rotating spring 53. As a result, the restriction members 61 and 62 rotate from the restriction position toward the release position. Then, when the restriction members 61 and 62 are disposed at the release position, the transport controller 82 stops the driving of the first motor 71.

Figure 10:
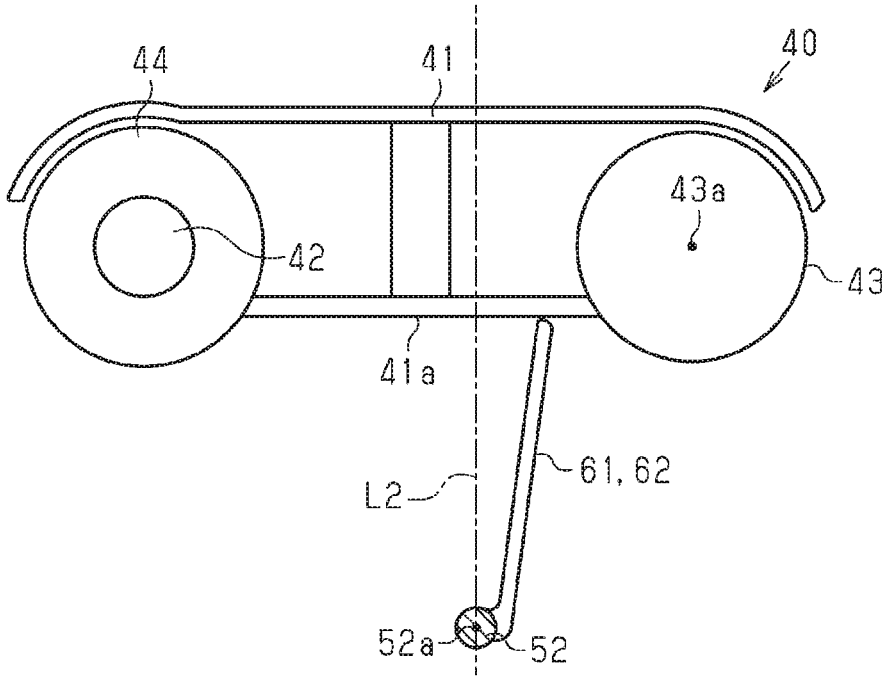
FIG. 10 is an operation diagram of a medium transport device that constitutes the image reading apparatus.
Figure 11:
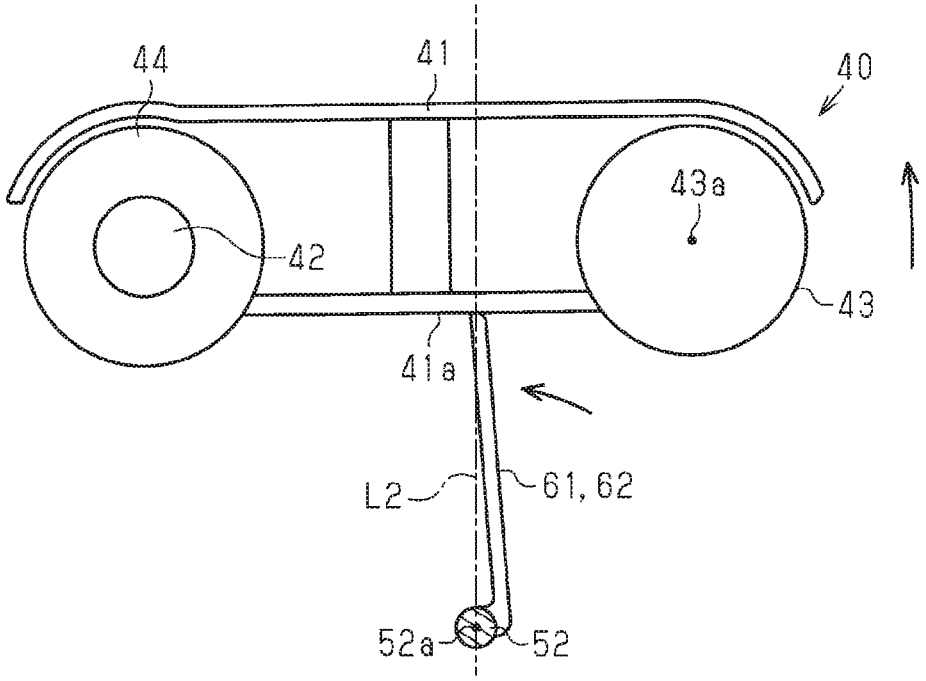
FIG. 11 is an operation diagram of the medium transport device.
Figure 12:
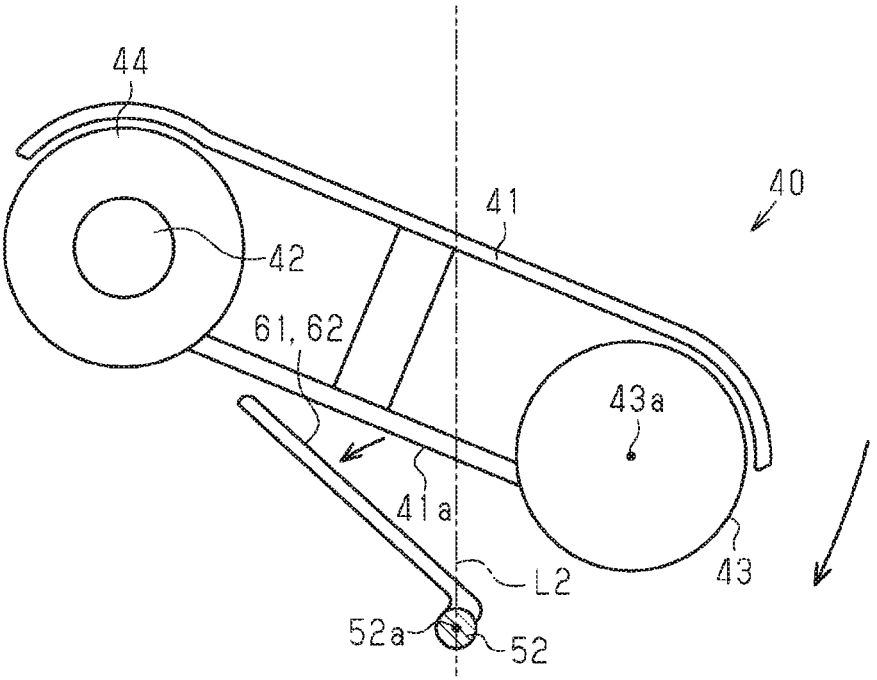
FIG. 12 is an operation diagram of the medium transport device.

When the restriction members 61 and 62 are rotated from the restriction position to the release position as described above, the feeding unit 40 disposed at the retracted position is displaced as illustrated in FIGS. 10, 11 and 12. That is, when the straight line extending in the vertical direction X among the straight lines orthogonal to the rotation axis 52*a* that is the rotation axis of the first restriction member 61 is a vertical straight line L2, as illustrated in FIGS. 10 and 11, the feeding unit 40 rotates in a direction in which the feeding roller 43 is separated from the mounting portion 31 until the tip end 61*b* of the first restriction member 61 is positioned on the vertical straight line L2. Then, after the tip end 61*b* of the first restriction member 61 is positioned on the vertical straight line L2, as illustrated in FIGS. 11 and 12, the feeding unit 40 rotates in a direction in which the feeding roller 43 approaches the mounting portion 31. That is, the feeding unit 40 rotates toward the contact position. Then, when the feeding roller 43 is brought into contact with the medium 100 mounted on the mounting portion 31, the rotation of the feeding unit 40 is stopped.

Next, the operation and effect of this embodiment will be described.

(1) When the medium 100 is mounted on the mounting surface 31*a* of the mounting portion 31 in the state in which each first restriction member 61 is positioned at the release position, the feeding unit 40 is positioned near the contact position and the feeding roller 43 is in contact with the medium 100 mounted on the mounting surface 31*a*. For that reason, the medium 100 is fed to the downstream from the mounting portion 31 in the transport direction Y by rotating the feeding roller 43. When each first restriction member 61 rotates from the release position to the restriction position, the feeding unit 40 is disposed at the retracted position. In this case, the tip end 61*b* of each first restriction member 61 is in contact with the feeding unit 40, and thus the feeding unit 40 is maintained in a state in which the feeding unit is positioned at the retracted position. In this case, the tip end 61*b* of each first restriction member 61 is positioned closer to the mounting portion 31 than the position of the restricting rotation shaft 52 in the transport direction Y in the upstream transport path 310.

When each of the first restriction members 61 is positioned at the restriction position in this way, a load may be input to each first restriction member 61 from the medium 100 mounted on the mounting surface 31*a*. The load acts on each first restriction member 61 in the direction of rotating from the restriction position to the release position. In this embodiment, when each first restriction member 61 is positioned at the restriction position, since the tip end 61*b* of each first restriction member 61 is positioned closer to the mounting portion 31 side than the restricting rotation shaft 52 in the transport direction Y in the upstream transport path 310, in order to rotate each first restriction member 61 from the restriction position toward the release position, it is necessary to rotate the feeding unit 40 in the direction away from the contact position. That is, the force that restricts the movement from the restriction position to the release position acts on each first restriction member 61 from the feeding unit 40. As a result, when a load is input from the medium 100 mounted on the mounting surface 31*a* to each first restriction member 61, it is possible to prevent each first restriction member 61 from rotating toward the release position. Accordingly, it is possible to prevent the state in which the feeding unit 40 is positioned at the retracted position from being released.

(2) In this embodiment, the angle θ illustrated in FIG. 4 is less than "90°". With this configuration, when a load that rotates the first restriction member 61 toward the release position is input to each first restriction member 61 positioned at the restriction position, the force to displace from the retracted position toward the contact position can be efficiently transmitted from the feeding unit 40 to each first restriction member 61. As a result, it is possible to enhance the effect of preventing the release of the state in which the feeding unit 40 is positioned at the retracted position.

(3) When the medium 100 is transported along the transport path 300, when the entire first restriction members 61 are disposed on the side opposite to the upstream transport path 310 with the transport guide 32 interposed therebetween, there is a concern that the tip end of the transported medium 100 is caught by the opening edge of the first insertion hole 32*b* of the transport guide 32. Therefore, when each first restriction member 61 is positioned at the release position, it is preferable to insert the first insertion hole 32*b* provided in the transport guide 32 and dispose a part of each first restriction member 61 in the upstream transport path 310. According to this, it is possible to prevent the tip end of the medium 100 to be transported from being caught by the opening edge of the first insertion hole 32*b* by the portion of each first restriction member 61 positioned in the upstream transport path 310.

(4) It is preferable that the friction coefficient of the part opposed to the feeding unit 40 in the portion positioned on the upstream transport path 310 when the first restriction member 61 is positioned at the release position of each first restriction member 61 is made higher than a friction coefficient of the path section surface 32*a*. According to this, when the plurality of media 100 are transported in an overlapping state, the medium 100 positioned closest to the transport guide 32 side among the plurality of media 100 may be brought into contact with a portion of each first restriction member 61 positioned within the upstream transport path 310. In such a case, since the friction coefficient of the portion is high, it is possible to prevent the medium 100, which is positioned closest to the transport guide 32 side, of the plurality of media 100 from being transported to the downstream in the transport direction Y. That is, double feeding of the medium 100 can be prevented.

(5) When each first restriction member 61 is positioned at the restriction position, it is preferable that the coupling part between the first restriction member 61 and the restricting rotation shaft 52 is disposed upstream of the rotation axis 52*a* of the restricting rotation shaft 52 in the transport direction Y in the upstream transport path 310. According to this, when each first restriction member 61 is positioned at the restriction position, it becomes easier to dispose the tip end 61*b* of each first restriction member 61 closer to the mounting portion 31 side than the restricting rotation shaft 52 in the transport direction Y in the upstream transport path 310.

(6) The second restriction members 62 may be provided on the restricting rotation shaft 52. In this case, by disposing each first restriction member 61 at the restriction position, the movement of the medium 100 mounted on the mounting surface 31*a* to the downstream in the transport direction Y can be restricted by both of each first restriction member 61 and each second restriction member 62.

(7) The length of the second restriction member 62 is preferably longer than the length of the first restriction member 61. With this configuration, even when the tip end of the medium 100 mounted on the mounting surface 31*a* is curled, the movement of the medium 100 to the downstream of the transport direction Y can be prevented by the second restriction member 62.

Second Embodiment

Next, a second embodiment of the medium transport device will be described with reference to FIGS. 13 and 14. In the following description, the portions that are different from those of the first embodiment will be mainly described, and the same reference numerals are given to the same or corresponding member configurations as those of the first embodiment, and duplicate description thereof will be omitted.

Figure 14:
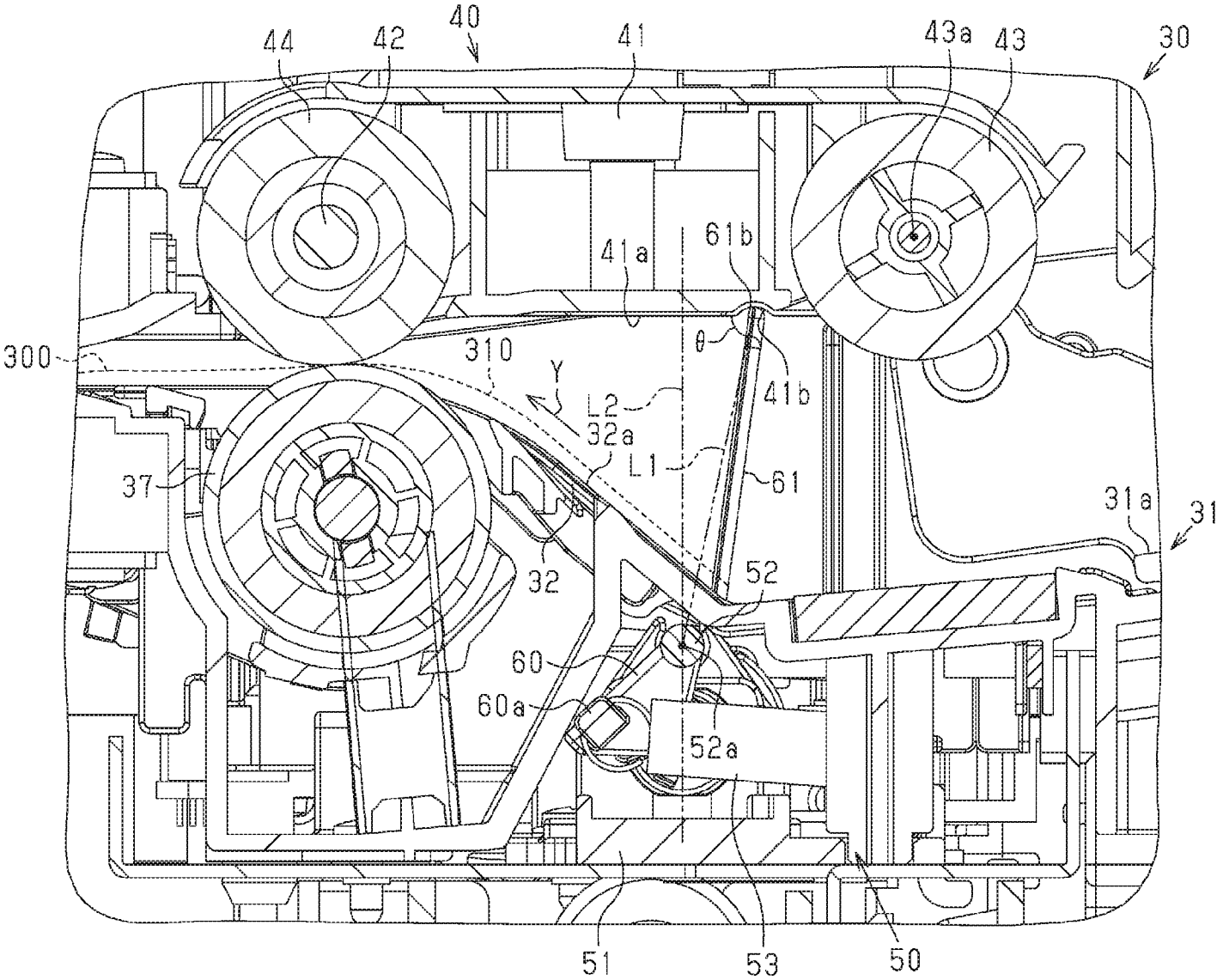
FIG. 14 is a cross-sectional view illustrating a part of an image reading apparatus of the second embodiment.

As illustrated in FIG. 14, the unit section surface 41*a* of the feeding unit main body 41 is provided with a restricting recess 41*b* in which the tip end 61*b* of the first restriction member 61 is accommodated. The inside of the restricting recess 41*b* communicates with the upstream transport path 310. When each first restriction member 61 is disposed at the restriction position and the feeding unit 40 is positioned at the retracted position, the tip end 61*b* of the first restriction member 61 is accommodated in the restricting recess 41*b*. As such, when the tip end 61*b* of each first restriction member 61 positioned in the restriction position is accommodated in the restricting recess 41*b*, the wall surface of the restricting recess 41*b* serves to restrict the rotation of the first restriction member 61. For that reason, the effect of preventing the movement of the first restriction member 61 from the restriction position to the release position can be enhanced.

Next, with reference to FIG. 13, a flow of a process when rotating the first restriction member 61 positioned at the restriction position to the retracted position and displacing the feeding unit 40 from the retracted position toward the contact position will be described.

First, in step S11, a contact release process is executed by the transport controller 82. That is, the clutch 75 is brought into the engagement state. Then, the second motor 72 is driven to rotate the feeding unit 40 in a direction in which the feeding roller 43 is separated from the mounting surface 31*a*. With this configuration, the tip end 61*b* of each first restriction member 61 escapes from the restricting recess 41*b*. Subsequently, in the next step S12, a rotation process is executed by the transport controller 82. That is, the first motor 71 is driven so that the output shaft thereof rotates in the reverse direction. Then, the driving force of the first motor 71 is transmitted to the restricting drive shaft 54 of the restriction portion 50 via the second one-way clutch 74. Then, in the restriction portion 50, contact between the protruding portion 57 and the pressed portion 60 is eliminated, and thus each first restriction member 61 is rotated from the restriction position to the retracted position by the force input from the rotating spring 53 to the pressed portion 60.

After the rotation of each first restriction member 61 to the retracted position is started in this way, the process proceeds to the next step S13. In step S13, the transport controller 82 executes an approaching process. That is, the driving of the first motor 71 is stopped and the clutch 75 is brought into the disengagement state. Then, since the restriction members 61 and 62 do not contact the feeding unit 40, the feeding unit 40 rotates toward the contact position. When the feeding roller 43 is brought into contact with the medium 100 mounted on the mounting surface 31*a*, a series of processes illustrated in FIG. 13 are ended.

Figure 13:
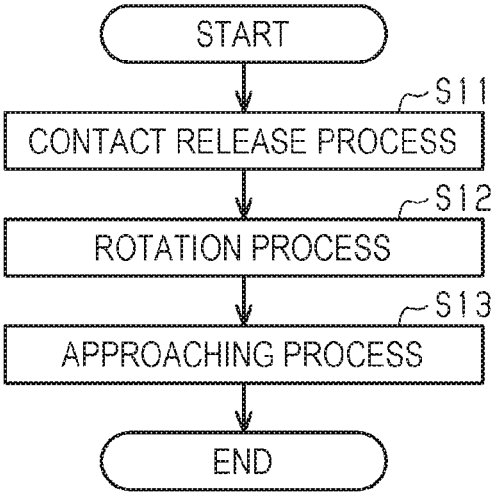
FIG. 13 is a flowchart illustrating a flow of a process executed by a transport controller in a medium transport device of a second embodiment.

By executing the series of processes illustrated in FIG. 13, even if the feeding unit 40 is provided with the restricting recess 41*b*, the restriction members 61 and 62 can be rotated from the restriction position to the retracted position. The feeding unit 40 can be disposed at the retracted position, or the feeding unit 40 can be displaced to the contact position or the vicinity of the contact position.

Modification Example

The embodiments described above can be modified and embodied as follows. The embodiments described above and the following modification example can be embodied in combination with each other within a technically consistent range.

Figure 15:
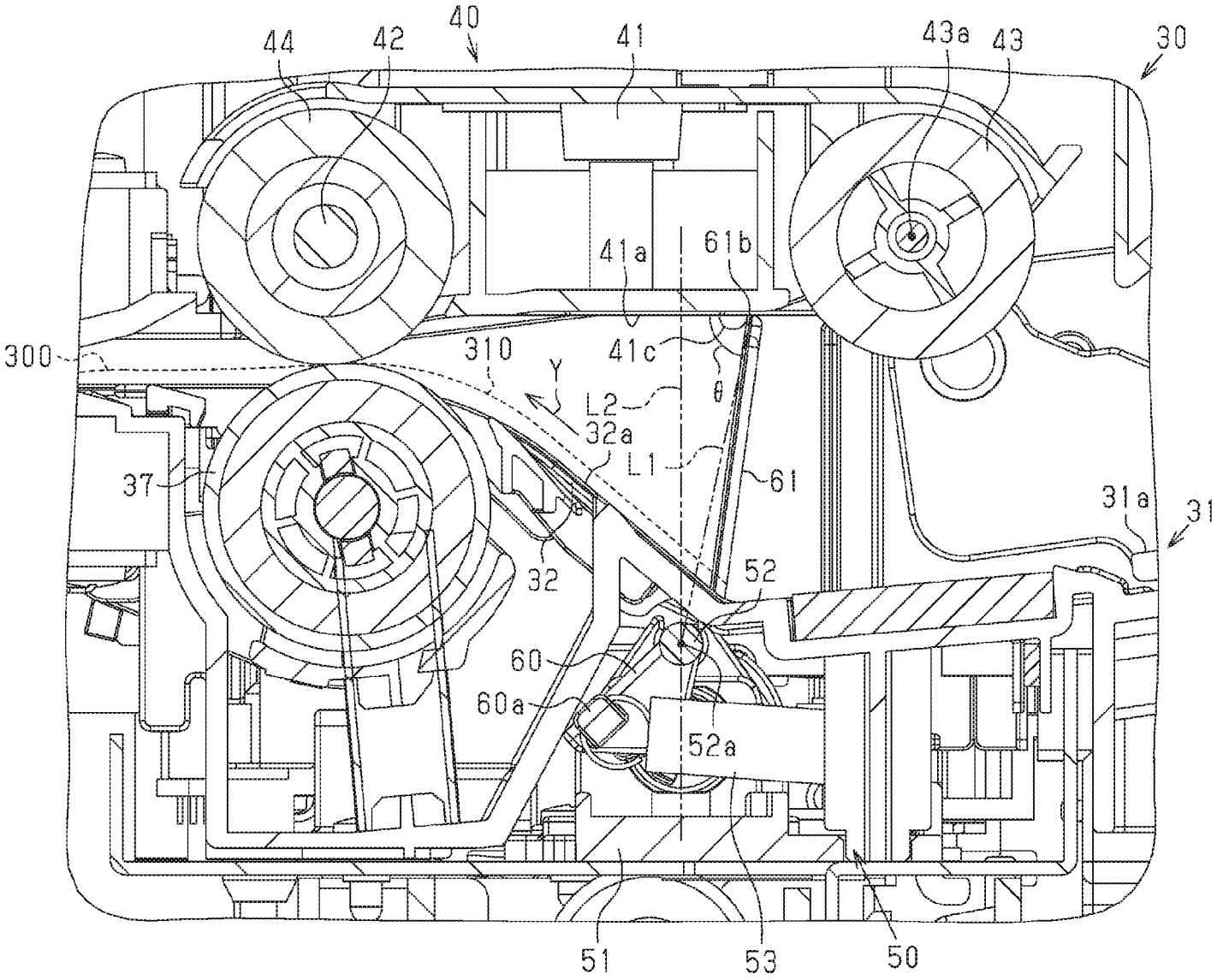
FIG. 15 is a cross-sectional view illustrating a part of a medium transport device of a modification example.

In the second embodiment, as illustrated in FIG. 15, the feeding unit 40 may be provided with a restricting protrusion 41*c* instead of the restricting recess 41*b*. For example, when the feeding unit 40 is positioned at the retracted position and the first restriction member 61 is positioned at the restriction position, the restricting protrusion 41*c* may be disposed between the tip end 61*b* of the first restriction member 61 and the rotation axis 52*a* of the restricting rotation shaft 52 in the transport direction Y. With this configuration, when the feeding unit 40 is positioned at the retracted position and the first restriction member 61 is positioned at the restriction position, the tip end 61*b* of the first restriction member 61 contacts the restricting protrusion 41*c* from the upstream in the transport direction Y. For that reason, the rotation of the first restriction member 61 from the restriction position to the retracted position can be restricted by the restricting protrusion 41*c*.

When the restricting protrusion 41*c* is provided in this way, the first restriction member 61 may be configured such that when the first restriction member 61 is positioned at the restriction position, the tip end 61*b* of the first restriction member 61 is positioned on the vertical straight line L2 orthogonal to the rotation axis 52*a* of the restricting rotation shaft 52. In this case, when the feeding unit 40 is positioned at the retracted position and the first restriction member 61 is positioned at the restriction position, the rotation of the first restriction member 61 from the restriction position to the retracted position can be restricted by the restricting protrusion 41*c* by disposing the restricting protrusion 41*c* downstream of the tip end 61*b* of the first restriction member 61 positioned on the vertical straight line L2 in the transport direction Y.

In the second embodiment, the first restriction member 61 may be configured such that when the first restriction member 61 is positioned at the restriction position, the tip end 61*b* of the first restriction member 61 is positioned on the vertical straight line L2 orthogonal to the rotation axis 52*a* of the restricting rotation shaft 52.

In the embodiments described above, the restricting rotation shaft 52 is disposed on the side opposite to the upstream transport path 310 with the transport guide 32 interposed therebetween and the tip end 61*b* of the first restriction member 61 is brought into contact with the feeding unit 40. However, the restricting rotation shaft 52 may be provided in the feeding unit 40 and the tip end 61*b* of the first restriction member 61 may be brought into contact with the transport guide 32. In this case, the transport guide 32 corresponds to the "contact target". Even with this configuration, the tip end 61*b* of the first restriction member 61 can be brought into contact with the transport guide 32 by disposing the first restriction member 61 at the restriction position, and thus the feeding unit 40 can be maintained in a state in which the feeding unit is positioned at the retracted position. When the first restriction member 61 is disposed in the restriction position and the feeding unit 40 is maintained in the state of being positioned at the retracted position, the tip end 61*b* of the first restriction member 61 is disposed closer to the mounting portion 31 than the position of the rotation axis of the first restriction member 61 in the transport direction Y in the upstream transport path 310. With this configuration, even if the load from the medium 100 mounted on the mounting portion 31 is input to the first restriction member 61, the rotation of the first restriction member 61 from the restriction position to the retracted position can be prevented, and thus the state in which the feeding unit 40 is positioned at the retracted position can be maintained.

Figure 16:
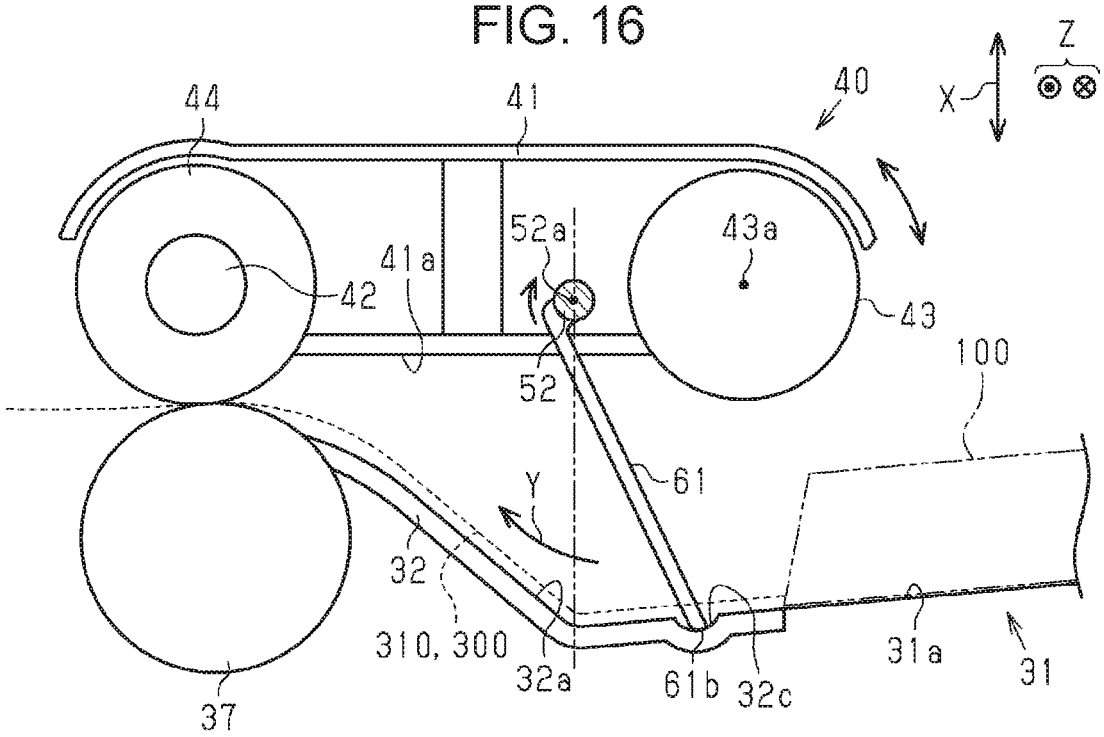
FIG. 16 is a schematic diagram illustrating a part of the medium transport device of the modification example.

FIG. 16 illustrates an example of a case where the transport guide 32 is provided with an accommodation recess 32*c* in which the tip end 61*b* is accommodated when the first restriction member 61 is positioned at the restriction position.

Figure 17:
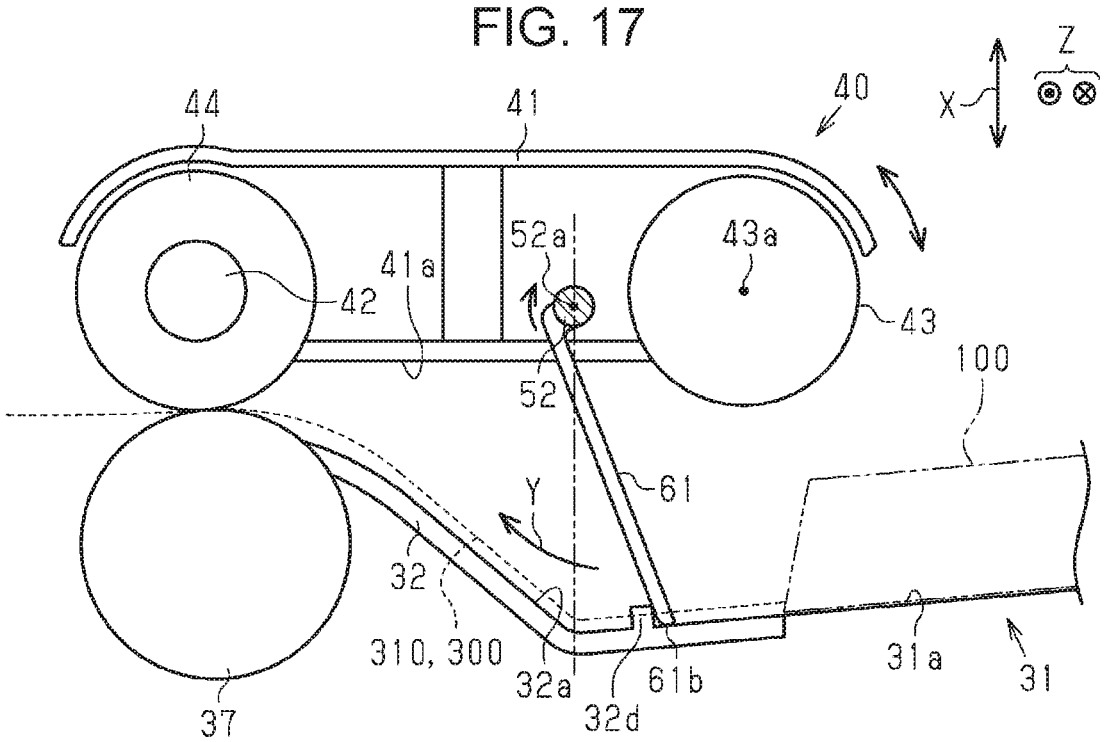
FIG. 17 is a schematic diagram illustrating a part of the medium transport device of the modification example.

FIG. 17 illustrates an example of a case where the transport guide 32 is provided with a restricting protrusion 32*d* with which the tip end 61*b* contacts from the upstream in the transport direction Y when the first restriction member 61 is positioned at the restriction position.

The length of the second restriction member 62 need not be longer than the length of the first restriction member 61. That is, the length of the second restriction member 62 may be equal to the length of the first restriction member 61, or the length of the second restriction member 62 may be shorter than the length of the first restriction member 61. In this case, the reading portion cover 14 may not be provided with the accommodation recess 14*a*.

In the embodiments described above, the second restriction members 62 are respectively disposed on both sides of the first restriction members 61 in the medium width direction Z. However, the second restriction member 62 may be provided on either one of both sides of the first restriction members 61 in the medium width direction Z, while the second restriction member 62 may not be provided on the other side.

The second restriction member 62 may not be provided.

The coupling part between the first restriction member 61 and the restricting rotation shaft 52 need not be provided closer to the mounting portion 31 side than the restricting rotation shaft 52 in the upstream transport path 310 when the first restriction member 61 is positioned at the restriction position. For example, in a mode in which the tip end 61*b* of the first restriction member 61 is positioned on a straight line coupling the rotation axis 52*a* of the restricting rotation shaft 52 and the base end 61*a* of the first restriction member 61 in a cross-section obtained by cutting the restricting rotation shaft 52 and the first restriction member 61 in a direction orthogonal to the medium width direction Z, the first restriction member 61 may be coupled to the restricting rotation shaft 52.

The friction coefficient of the part of the first restriction member 61 opposed to the feeding unit 40 in the portion positioned on the upstream transport path 310 when the first restriction member 61 is positioned at the release position need not be higher than a friction coefficient of the path section surface 32*a*.

The release position may be the position of the first restriction member 61 such that the first restriction member 61 is disposed outside the upstream transport path 310.

In the second embodiment, in the approaching process illustrated in FIG. 13, the driving force of the second motor 72 is not transmitted to the unit rotation shaft 42 but the feeding unit 40 is displaced toward the approaching position by its own weight. However, in the approaching process, the feeding unit 40 may be displaced toward the approaching position by transmitting the driving force of the second motor 72 to the unit rotation shaft 42, that is, by driving the second motor 72.

In the cross-section obtained by cutting the first restriction member 61 and the feeding unit 40 in the direction orthogonal to the medium width direction Z, the angle θ between the surface of the unit section surface 41*a* downstream of the contact part with the tip end 61*b* of the first restriction member 61 in the transport direction Y when the feeding unit 40 is positioned at the retracted position and the straight line L1 coupling the rotation axis 52*a*, which is the rotation axis of the first restriction member 61, and the tip end 61*b* need not be less than "90°". Even in this case, when the first restriction member 61 is positioned at the restriction position, as long as the tip end 61*b* of the first restriction member 61 is positioned between the rotation axis 52*a* of the restricting rotation shaft 52 and the mounting portion 31 in the transport direction Y in the upstream transport path 310, the rotation of the first restriction member 61 from the restriction position to the retracted position can be prevented even if the load from the medium 100 mounted on the mounting portion 31 is input to the first restriction member 61. That is, the state in which the feeding unit 40 is positioned at the retracted position can be maintained.

The number of the first restriction members 61 may be one, or may be any number of three or more.

The medium transport device 30 may be provided in an apparatus other than the image reading apparatus 20 as long as it is an apparatus that performs some processes on the medium transported along the transport path 300. For example, the medium transport device 30 may be applied to a printing apparatus that executes a printing process on a medium.

The control device 80 may be configured as a circuit including one or more processors that operate according to a computer program, one or more dedicated hardware circuits such as dedicated hardware that executes at least some of various processes, or a combination thereof. The dedicated hardware may be, for example, an ASIC that is an integrated circuit for a specific application. The processor includes a CPU and memory such as RAM and ROM, and the memory stores program codes or instructions configured to cause the CPU to perform a process. The memory, that is, storage media, includes any available media that can be accessed by a general purpose or special purpose computer.

In the following, the technical idea and obtained from the embodiments and modification example described above effects thereof will be described.

(A) A medium transport device according to an aspect is a medium transport device that transports a medium along a transport path, including a mounting portion that includes a mounting surface on which the medium is mounted, a feeding unit that includes a feeding roller feeding the medium mounted on the mounting surface to a downstream in a transport direction and is configured to be disposed at a contact position at which the feeding roller contacts the mounting surface and a retracted position at which the feeding roller is separated from the mounting surface and contact between the medium mounted on the mounting surface and the feeding roller is disabled, and a restriction member that, when a width direction of the medium mounted on the mounting surface is a medium width direction, the width direction intersecting the transport direction, rotates between a restriction position and a release position around a rotation axis that extends in the medium width direction and is disposed downstream of the mounting portion in the transport direction, and a transport guide positioned on a side opposite to the feeding unit with the transport path interposed therebetween. The release position is a position where a tip end of the restriction member is disposed downstream in the transport direction, as compared with a case where the restriction member is positioned at the restriction position. When the restriction member is positioned at the restriction position, the restriction member maintains a state in which the feeding unit is positioned at the retracted position, and restricts a movement of the medium mounted on the mounting surface to the downstream in the transport direction, and when the restriction member is positioned at the release position, the restriction member allows displacement of the feeding unit to the contact position and allows a movement of the medium mounted on the mounting portion to the downstream in the transport direction. When the restriction member is positioned at the restriction position, the tip end of the restriction member is positioned closer to a mounting portion side than a position of the rotation axis in the transport direction in the transport path.

According to the configuration described above, when the restriction member is positioned at the release position in the state in which the medium is mounted on the mounting surface, the feeding unit is positioned near the contact position and the feeding roller contacts the medium mounted on the mounting surface. For that reason, by rotating the feeding roller, the medium is fed from the mounting portion to the downstream in the transport direction. When the restriction member rotates from the release position to the restriction position, the feeding unit is disposed at the retracted position. In this case, since the tip end of the restriction member is in contact with the contact target, the state in which the feeding unit is positioned at the retracted position is maintained. In this case, the tip end of the restriction member is positioned closer to the mounting portion than the position of the rotation axis of the restriction member in the transport direction in the upstream transport path.

When the restriction member is positioned at the restriction position in this way, a load may be input to the restriction member from the medium mounted on the mounting surface. The load acts on the restriction member in the direction of rotating the restriction member from the restriction position to the release position. According to the configuration described above, when the restriction member is positioned at the restriction position, since the tip end of the restriction member is positioned between the rotation axis in the transport direction and the mounting portion, it is necessary to displace the feeding unit in the direction away from the contact position in order to rotate the restriction member from the restriction position to the release position. That is, a force that restricts the movement from the restriction position to the release position acts on the restriction member from the feeding unit. As a result, when a load is input to the restriction member from the medium mounted on the mounting surface, it is possible to prevent the restriction member from rotating toward the release position, and thus to prevent the state in which the feeding unit is positioned at the retracted position from being released.

(B) In the medium transport device according to the aspect, the rotation axis is positioned on a side opposite to the transport path with the transport guide interposed therebetween and a contact target is the feeding unit.

According to the configuration described above, when the restriction member is disposed at the restriction position, the state in which the feeding unit is positioned at the retracted position can be maintained by bringing the tip end of the restriction member into contact with the feeding unit.

(C) In the medium transport device according to the aspect, the feeding unit is preferably has a unit section surface facing the transport path. In this medium transport device, in a cross-section obtained by cutting the restriction member and the feeding unit in a direction orthogonal to the medium width direction, an angle formed between a surface of the unit section surface downstream of a contact part with the tip end of the restriction member in the transport direction and a straight line coupling the rotation axis and the tip end of the restriction member may be less than "90°" when a state in which the restriction member is positioned at the restriction position and the feeding unit is positioned at the retracted position is maintained.

According to the configuration described above, when a load to rotate the restriction member toward the release position is input to the restriction member positioned at the restriction position, a force to displace from the retracted position toward the contact position can be efficiently transmitted from the feeding unit to the restriction member.

(D) In the medium transport device, the feeding unit is preferably provided with a restricting recess in which the tip end of the restriction member is accommodated when the restriction member is positioned at the restriction position.

According to the configuration described above, when the tip end of the restriction member positioned at the restriction position is accommodated in the restricting recess, a wall surface of the restricting recess serves to restrict the rotation of the restriction member. For that reason, the effect of preventing the movement of the restriction member from the restriction position to the release position can be enhanced.

(E) In the medium transport device, the feeding unit is preferably provided with a restricting protrusion with which the tip end of the restriction member comes into contact from an upstream in the transport direction when the restriction member is positioned at the restriction position.

According to the configuration described above, the rotation of the restriction member from the restriction position to the release position can be prevented by the restricting protrusion. As a result, the effect of preventing the movement of the restriction member from the restriction position to the release position can be enhanced.

(F) An aspect of a medium transport device is a medium transport device that transports a medium along a transport path, including a mounting portion that includes a mounting surface on which the medium is mounted, a feeding unit that includes a feeding roller feeding the medium mounted on the mounting surface to a downstream in a transport direction and is configured to be disposed at a contact position at which the feeding roller contacts the mounting surface and a retracted position at which the feeding roller is separated from the mounting surface and contact between the medium mounted on the mounting surface and the feeding roller is disabled, and, when a width direction of the medium mounted on the mounting surface is a medium width direction, the width direction intersecting the transport direction, a restriction member that rotates between a restriction position and a release position around a rotation axis that extends in the medium width direction and is disposed downstream of the mounting portion in the transport direction, and a transport guide positioned on a side opposite to the feeding unit with the transport path interposed therebetween. The release position is a position where a tip end of the restriction member is disposed downstream in the transport direction, as compared with a case where the restriction member is positioned at the restriction position. When the restriction member is positioned at the restriction position, the restriction member maintains a state in which the feeding unit is positioned at the retracted position, and restricts a movement of the medium mounted on the mounting surface to the downstream in the transport direction, and when the restriction member is positioned at the release position, the restriction member allows displacement of the feeding unit to the contact position and allows a movement of the medium mounted on the mounting portion to the downstream in the transport direction. A contact target is provided with a restricting recess in which the tip end of the restriction member is accommodated when the restriction member is positioned at the restriction position.

According to the configuration described above, when the tip end of the restriction member positioned at the restriction position is accommodated in the restricting recess, the wall surface of the restricting recess serves to restrict the rotation of the restriction member. For that reason, the movement of the restriction member from the restriction position to the release position can be prevented. Accordingly, when a load is input to the restriction member from the medium mounted on the mounting portion, it is possible to prevent the restriction member from rotating toward the release position, and thus to prevent the state in which the feeding unit is positioned at the retracted position from being released.

(G) An aspect of a medium transport device is a medium transport device that transports a medium along a transport path, including a mounting portion that includes a mounting surface on which the medium is mounted, a feeding unit that includes a feeding roller feeding the medium mounted on the mounting surface to a downstream in a transport direction and is configured to be disposed at a contact position at which the feeding roller contacts the mounting surface and a retracted position at which the feeding roller is separated from the mounting surface and contact between the medium mounted on the mounting surface and the feeding roller is disabled, and, when a width direction of the medium mounted on the mounting surface is a medium width direction, the width direction intersecting the transport direction, a restriction member that rotates between a restriction position and a release position around a rotation axis that extends in the medium width direction and is disposed downstream of the mounting portion in the transport direction, and a transport guide positioned on a side opposite to the feeding unit with the transport path interposed therebetween. The release position is a position where a tip end of the restriction member is disposed downstream in the transport direction, as compared with a case where the restriction member is positioned at the restriction position. When the restriction member is positioned at the restriction position, the restriction member maintains a state in which the feeding unit is positioned at the retracted position, and restricts a movement of the medium mounted on the mounting surface to the downstream in the transport direction, and when the restriction member is positioned at the release position, the restriction member allows displacement of the feeding unit to the contact position and allows a movement of the medium mounted on the mounting portion to the downstream in the transport direction. The contact target is provided with a restricting protrusion with which the tip end of the restriction member comes into contact from an upstream in the transport direction when the restriction member is positioned at the restriction position.

According to the configuration described above, the rotation of the restriction member from the restriction position to the release position can be prevented by the restricting protrusion. Accordingly, when a load is input to the restriction member from the medium mounted on the mounting portion, the restriction member can be prevented from rotating toward the release position, and thus to prevent the state in which the feeding unit is positioned at the retracted position from being released.

(H) The medium transport device according to the aspect further includes a power source that drives the feeding unit to be displaced and a transport controller that controls displacement of the feeding unit and rotation of the restriction member. In this medium transport device, when the transport controller causes the restriction member to rotate from the restriction position to the release position, the transport controller may cause the feeding unit to be displaced in a direction opposite to the contact position from the retracted position by driving the power source, cause rotation of the restriction member from the restriction position to the release position to start in this state, and then cause the feeding unit to be displaced toward the contact position.

According to the configuration described above, when the restriction member is rotated from the restriction position to the release position and the feeding unit is displaced from the retracted position toward the contact position, the feeding unit is displaced in the direction opposite to the contact position by driving the power source. With this configuration, contact between the restriction member and the feeding unit can be eliminated. In this state, the rotation of the restriction member from the restriction position to the release position is started. Then, the feeding unit is displaced toward the contact position. As a result, when the medium is mounted on the mounting portion, the feeding roller can be brought into contact with the medium.

(I) In the medium transport device according to the aspect, the transport guide is provided with an insertion hole through which the restriction member passes. In the medium transport device, the release position is a position of the restriction member where a part of the restriction member is disposed in the transport path.

According to the configuration described above, even when the restriction member is positioned at the release position, a part of the restriction member is positioned in the upstream transport path by being inserted through the insertion hole provided in the transport guide. With this configuration, it is possible to prevent the tip end of the medium transported downstream in the transport direction from being caught by the edge of the insertion hole.

(J) In the medium transport device according to the aspect, the rotation axis is positioned on a side opposite to the transport path with the transport guide interposed therebetween. In this medium transport device, the contact target is the feeding unit. The transport guide is provided with an insertion hole through which the restriction member passes. The release position is a position of the restriction member where a part of the restriction member is disposed in the transport path.

According to the configuration described above, even when the restriction member is positioned at the release position, a part of the restriction member is positioned in the upstream transport path by being inserted through the insertion hole provided in the transport guide. With this configuration, it is possible to prevent the tip end of the medium transported downstream in the transport direction from being caught by the edge of the insertion hole.

(K) In the medium transport device, it is preferable that a friction coefficient of a part of the restriction member opposed to the feeding unit in a portion positioned on the transport path when the restriction member is positioned at the release position is higher than a friction coefficient of a part of the transport guide facing the transport path.

According to the configuration described above, when the plurality of media are transported in an overlapping state, the medium positioned closest to the transport guide among the plurality of media may be brought into contact with the portion of the restriction member positioned within the transport path. In such a case, it becomes difficult for the medium to be transported to the downstream in the transport direction. That is, double feeding of the medium can be prevented.

(L) The medium transport device according to the aspect further includes a restricting rotation shaft that extends in the medium width direction and is coupled to the restriction member in a state of being integrally rotatable. In this medium transport device, the restriction member has a plate shape that extends in one direction. A base end of the restriction member is coupled to the restricting rotation shaft. A coupling part between the restriction member and the restricting rotation shaft is positioned closer to the mounting portion side than the restricting rotation shaft in the medium width direction in the transport path when the restriction member is positioned at the restriction position.

According to the configuration described above, when the restriction member is positioned at the restriction position, it becomes easy to dispose the tip end of the restriction member between the rotation axis in the transport direction and the mounting portion.

(M) The medium transport device according to the aspect, when the restriction member is a first restriction member, the medium transport device further includes a restricting rotation shaft that extends in the medium width direction and is coupled to a plurality of the first restriction members in a state of being integrally rotatable along the medium width direction, and a second restriction member that is positioned outside each of the first restriction members in the medium width direction and is coupled to the restricting rotation shaft in a state of being integrally rotatable. In the medium transport device, the second restriction member is positioned outside the feeding unit in the medium width direction, is positioned at the restriction position when each of the first restriction members is positioned at the restriction position, and is positioned at the release position when each of the first restriction members is positioned at the release position.

According to the configuration described above, by disposing each of the first restriction members at the restriction position, it is possible to restrict the movement of the medium mounted on the mounting portion to the downstream in the transport direction by both the first restriction member and the second restriction member. By disposing each first restriction member at the release position, the restriction on the movement of the medium to the downstream in the transport direction by each first restriction member and the second restriction member can be released.

(N) In the medium transport device, a shortest distance from the rotation axis to the tip end of the second restriction member is preferably longer than a shortest distance from the rotation axis to the tip end of the first restriction member.

According to the configuration described above, even when the tip end of the medium mounted on the mounting portion is curled, the movement of the medium in the transport direction to the downstream can be prevented by the second restriction member.

(O) An image reading apparatus preferably includes the medium transport device and a reading portion that reads an image of a medium transported by the medium transport device. According to this configuration, the image is read from the medium transported by the medium transport device.

What is claimed is:

1. A medium transport device that transports a medium along a transport path, comprising:

a mounting portion that includes a mounting surface on which the medium is mounted;

a feeding unit that includes a feeding roller feeding the medium mounted on the mounting surface to a downstream in a transport direction, wherein the feeding unit is configured to be disposed at (i) a contact position at which the feeding roller contacts the mounting surface and (ii) a retracted position at which the feeding roller is separated from the mounting surface and contact between the medium mounted on the mounting surface and the feeding roller is disabled;

a restriction member that, when a width direction of the medium mounted on the mounting surface is a medium width direction, the width direction intersecting the transport direction, (i) rotates between a restriction position and a release position around a rotation axis that extends in the medium width direction and (ii) is disposed downstream of the mounting portion in the transport direction; and a transport guide positioned on a side opposite to the feeding unit with the transport path interposed therebetween, wherein the release position is a position where a tip end of the restriction member is disposed downstream in the transport direction, as compared with a case where the restriction member is positioned at the restriction position, when the restriction member is positioned at the restriction position, the restriction member maintains a state in which the feeding unit is positioned at the retracted position, and restricts a movement of the medium mounted on the mounting surface to the downstream in the transport direction, when the restriction member is positioned at the release position, the restriction member allows displacement of the feeding unit to the contact position, and allows the movement of the medium mounted on the mounting surface to the downstream in the transport direction, and when the restriction member is positioned at the restriction position, the tip end of the restriction member is positioned between the mounting portion and a position of the rotation axis of the restriction member in the transport direction in the transport path.

2. The medium transport device according to claim 1, wherein the rotation axis is positioned on a side opposite to the transport path with the transport guide interposed therebetween, and when the restriction member is positioned at the restriction position, the tip end of the restriction member is in contact with the feeding unit.

3. The medium transport device according to claim 2, wherein the feeding unit has a unit section surface facing the transport path, and in a cross-section obtained by cutting the restriction member and the feeding unit in a direction orthogonal to the medium width direction, an angle formed between a surface of the unit section surface downstream of a contact part with the tip end of the restriction member in the transport direction and a straight line coupling the rotation axis and the tip end of the restriction member is less than "90°" when a state in which the restriction member is positioned at the restriction position and the feeding unit is positioned at the retracted position is maintained.

4. The medium transport device according to claim 2, wherein the feeding unit is provided with a restricting recess in which the tip end of the restriction member is accommodated when the restriction member is positioned at the restriction position.

5. The medium transport device according to claim 4, further comprising:

a power source that drives the feeding unit to be displaced; and a transport controller that controls the displacement of the feeding unit and the rotation of the restriction member, wherein when the transport controller causes the restriction member to rotate from the restriction position to the release position, the transport controller causes the feeding unit to be displaced in a direction opposite to the contact position from the retracted position by driving the power source, causes the rotation of the restriction member from the restriction position to the release position to start in this state, and then causes the feeding unit to be displaced toward the contact position.

6. The medium transport device according to claim 2, wherein the feeding unit is provided with a restricting protrusion with which the tip end of the restriction member comes into contact from an upstream in the transport direction when the restriction member is positioned at the restriction position.

7. The medium transport device according to claim 2, wherein the transport guide is provided with an insertion hole through which the restriction member passes, and the release position is a position of the restriction member where a portion of the restriction member is disposed in the transport path.

8. The medium transport device according to claim 7, wherein when the restriction member is positioned at the release position, a friction coefficient of a part of the portion of the restriction member opposed to the feeding unit is higher than a friction coefficient of a part of the transport guide facing the transport path.

9. The medium transport device according to claim 1, further comprising:

a restricting rotation shaft that extends in the medium width direction and is coupled to the restriction member in a state of being integrally rotatable, wherein the restriction member has a plate shape that extends in one direction, a base end of the restriction member is coupled to the restricting rotation shaft, and a coupling part between the restriction member and the restricting rotation shaft is positioned closer to a mounting portion side than the restricting rotation shaft in the medium width direction in the transport path when the restriction member is positioned at the restriction position.

10. The medium transport device according to claim 1, further comprising:

a plurality of first restriction members, wherein the plurality of first restriction members includes the restriction member, a restricting rotation shaft that extends in the medium width direction and is coupled to the plurality of first restriction members in a state of being integrally rotatable along the medium width direction; and a second restriction member that is positioned outside each of the plurality of first restriction members in the medium width direction and is coupled to the restricting rotation shaft in a state of being integrally rotatable, wherein the second restriction member is positioned outside the feeding unit in the medium width direction, is positioned at the restriction position when each of the plurality of first restriction members is positioned at the restriction position, and is positioned at the release position when each of the plurality of first restriction members is positioned at the release position.

11. The medium transport device according to claim 10, wherein a shortest distance from the rotation axis to the tip end of the second restriction member is longer than a shortest distance from the rotation axis to the tip end of the first restriction member.

12. The medium transport device according to claim 1, wherein when the restriction member is positioned at the restriction position, the tip end of the restriction member is brought into contact with one of the feeding unit or the transport guide, and when the restriction member is positioned at the release position, the contact between the tip end of the restriction member and the one of the feeding unit or the transport guide is released.

13. An image reading apparatus comprising:

the medium transport device according to claim 1, and a reading portion that reads an image of the medium transported by the medium transport device.

14. A medium transport device that transports a medium along a transport path, comprising:

a mounting portion that includes a mounting surface on which the medium is mounted;

a feeding unit that includes a feeding roller feeding the medium mounted on the mounting surface to a downstream in a transport direction, wherein the feeding unit is configured to be disposed at (i) a contact position at which the feeding roller contacts the mounting surface and (ii) a retracted position at which the feeding roller is separated from the mounting surface and contact between the medium mounted on the mounting surface and the feeding roller is disabled;

a restriction member that, when a width direction of the medium mounted on the mounting surface is a medium width direction, the width direction intersecting the transport direction, (i) rotates between a restriction position and a release position around a rotation axis that extends in the medium width direction and (ii) is disposed downstream of the mounting portion in the transport direction; and a transport guide positioned on a side opposite to the feeding unit with the transport path interposed therebetween, wherein the release position is a position where a tip end of the restriction member is disposed downstream in the transport direction, as compared with a case where the restriction member is positioned at the restriction position, when the restriction member is positioned at the restriction position, the restriction member maintains a state in which the feeding unit is positioned at the retracted position, and restricts a movement of the medium mounted on the mounting surface to the downstream in the transport direction, when the restriction member is positioned at the release position, the restriction member allows displacement of the feeding unit to the contact position, and allows the movement of the medium mounted on the mounting portion to the downstream in the transport direction, a contact target is provided with a restricting recess in which the tip end of the restriction member is accommodated when the restriction member is positioned at the restriction position, and in the transport direction, the restricting recess is between the mounting portion and a position of the rotation axis of the restriction member.

15. The medium transport device according to claim 14, wherein the rotation axis is positioned on a side opposite to the transport path with the transport guide interposed therebetween, the contact target is the feeding unit, the transport guide is provided with an insertion hole through which the restriction member passes, and the release position is a position of the restriction member where a part of the restriction member is disposed in the transport path.

16. The medium transport device according to claim 14, further comprising:

a power source that drives the feeding unit to be displaced; and a transport controller that controls the displacement of the feeding unit and the rotation of the restriction member, wherein when the transport controller causes the restriction member to rotate from the restriction position to the release position, the transport controller causes the feeding unit to be displaced in a direction opposite to the contact position from the retracted position by driving the power source, causes the rotation of the restriction member from the restriction position to the release position to start in this state, and then causes the feeding unit to be displaced toward the contact position.

17. The medium transport device according to claim 16, wherein the rotation axis is positioned on a side opposite to the transport path with the transport guide interposed therebetween, the contact target is the feeding unit, the transport guide is provided with an insertion hole through which the restriction member passes, the release position is a position of the restriction member where a portion of the restriction member is disposed in the transport path, and when the restriction member is positioned at the release position, a friction coefficient of a part of the portion of the restriction member opposed to the feeding unit is higher than a friction coefficient of a part of the transport guide facing the transport path.

18. A medium transport device that transports a medium along a transport path, comprising:

a mounting portion that includes a mounting surface on which the medium is mounted;

a feeding unit that includes a feeding roller feeding the medium mounted on the mounting surface to a downstream in a transport direction, wherein the feeding unit is configured to be disposed at (i) a contact position at which the feeding roller contacts the mounting surface and (ii) a retracted position at which the feeding roller is separated from the mounting surface and contact between the medium mounted on the mounting surface and the feeding roller is disabled;

a restriction member that, when a width direction of the medium mounted on the mounting surface is a medium width direction, the width direction intersecting the transport direction, (i) rotates between a restriction position and a release position around a rotation axis that extends in the medium width direction and (ii) is disposed downstream of the mounting portion in the transport direction; and a transport guide positioned on a side opposite to the feeding unit with the transport path interposed therebetween, wherein the release position is a position where a tip end of the restriction member is disposed downstream in the transport direction, as compared with a case where the restriction member is positioned at the restriction position, when the restriction member is positioned at the restriction position, the restriction member maintains a state in which the feeding unit is positioned at the retracted position, and restricts a movement of the medium mounted on the mounting surface to the downstream in the transport direction, when the restriction member is positioned at the release position, the restriction member allows displacement of the feeding unit to the contact position, and allows the movement of the medium mounted on the mounting portion to the downstream in the transport direction, a contact target is provided with a restricting protrusion with which the tip end of the restriction member comes into contact from an upstream in the transport direction when the restriction member is positioned at the restriction position, and in the transport direction, the restricting protrusion is between the mounting portion and a position of the rotation axis of the restriction member.

19. The medium transport device according to claim 18, further comprising:

a power source that drives the feeding unit to be displaced; and a transport controller that controls the displacement of the feeding unit and the rotation of the restriction member, wherein when the transport controller causes the restriction member to rotate from the restriction position to the release position, the transport controller causes the feeding unit to be displaced in a direction opposite to the contact position from the retracted position by driving the power source, causes the rotation of the restriction member from the restriction position to the release position to start in this state, and then causes the feeding unit to be displaced toward the contact position.

20. The medium transport device according to claim 19, wherein the rotation axis is positioned on a side opposite to the transport path with the transport guide interposed therebetween, the contact target is the feeding unit, the transport guide is provided with an insertion hole through which the restriction member passes, the release position is a position of the restriction member where a portion of the restriction member is disposed in the transport path, and when the restriction member is positioned at the release position, a friction coefficient of a part of the portion of the restriction member opposed to the feeding unit is higher than a friction coefficient of a part of the transport guide facing the transport path.

* * * * *